US008720212B2

(12) United States Patent
Wakuta et al.

(10) Patent No.: US 8,720,212 B2
(45) Date of Patent: May 13, 2014

(54) AIR-CONDITIONING APPARATUS

(75) Inventors: Naoki Wakuta, Chiyoda-ku (JP); Yohei Kato, Chiyoda-ku (JP); Shinya Matsushita, Chiyoda-ku (JP); Takanori Omori, Chiyoda-ku (JP); Hirokuni Shiba, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 445 days.

(21) Appl. No.: 13/233,503

(22) Filed: Sep. 15, 2011

(65) Prior Publication Data

US 2012/0144852 A1 Jun. 14, 2012

(30) Foreign Application Priority Data

Dec. 9, 2010 (JP) ..... 2010-274694

(51) Int. Cl.
*F25B 31/00* (2006.01)

(52) U.S. Cl.
USPC ..... 62/193; 62/472

(58) Field of Classification Search
USPC ..... 62/84, 193, 472, 157
See application file for complete search history.

(56) References Cited

U.S. PATENT DOCUMENTS

| | | | | | |
|---|---|---|---|---|---|
| 4,236,379 | A | * | 12/1980 | Mueller | 62/126 |
| 4,444,017 | A | * | 4/1984 | Briccetti et al. | 62/84 |
| 5,012,652 | A | * | 5/1991 | Dudley | 62/192 |
| 5,230,222 | A | * | 7/1993 | Erbs | 62/192 |
| 2010/0162742 | A1 | * | 7/2010 | Shimoda et al. | 62/238.6 |
| 2012/0023984 | A1 | | 2/2012 | Sakai et al. | |

FOREIGN PATENT DOCUMENTS

| | | | | |
|---|---|---|---|---|
| JP | 7-167504 | A | | 7/1995 |
| JP | 08-061793 | A | | 3/1996 |
| JP | 08-261571 | A | | 10/1996 |
| JP | 2001-073952 | A | | 3/2001 |
| JP | 2001073952 | A | * | 3/2001 |
| JP | 2008-064447 | A | | 3/2008 |
| JP | 2010-210208 | A | | 9/2010 |
| JP | 2010210208 | A | * | 9/2010 |

OTHER PUBLICATIONS

Office Action (Notice of Reasons for Rejection) dated Nov. 27, 2012, issued by the Japanese Patent Office in the corresponding Japanese Patent Application No. 2010-274694 and an English translation thereof. (5 pages).

* cited by examiner

*Primary Examiner* — Allana Lewin
*Assistant Examiner* — Kun Kai Ma
(74) *Attorney, Agent, or Firm* — Buchanan Ingersoll & Rooney PC

(57) ABSTRACT

When a compressor is in a stopped state and an outside air temperature change rate Tah exceeds zero, a first heating operation is started, and a heating capacity of a compressor heating portion is set in a range not more than a heating capacity upper limit Pmax based on the outside air temperature change rate Tah. A remaining refrigerant liquid amount Ms condensed in the compressor that had not been evaporated is acquired based on the outside air temperature change rate Tah and the heating capacity. If the outside air temperature change rate Tah is zero or below and the remaining refrigerant liquid amount Ms exceeds zero while the compressor is in a stopped state, a second heating operation is started, the compressor heating portion 10 is controlled based on the remaining refrigerant liquid amount Ms, and the refrigerant condensed in the compressor 1 is evaporated.

15 Claims, 13 Drawing Sheets

AIR-CONDITIONING APPARATUS

BACKGROUND OF THE INVENTION

1. Field of the Invention

The present invention relates to an air-conditioning apparatus provided with a compressor.

2. Description of the Related Art

In air-conditioning apparatus, there are cases in which a refrigerant floods a compressor while the apparatus is stopped (hereinafter also referred to as "stagnation").

The refrigerant that has flooded the compressor dissolves in lubricant oil in the compressor. As a result, the concentration of the lubricant oil is decreased, and the viscosity of the lubricant oil is decreased.

If the compressor is started in this state, the lubricant oil with low viscosity provided to a rotation shaft and a compression portion of the compressor will raise the possibility of a sliding portion and the like in the compressor to be burned due to poor lubrication.

Also, flooding of the refrigerant in the compressor raises the liquid level in the compressor. As a result, start load of an electric motor which drives the compressor becomes higher, which is regarded as an overcurrent at the start of the air-conditioning apparatus, and the air-conditioning apparatus might not be able to be started.

In order to solve these problems, a measure has been taken to suppress refrigerant stagnation in the compressor by heating the compressor while the compressor is stopped.

As heating means to heat the compressor, supply of current to an electric heater wound around the compressor is known. A method of impressing low voltage with high frequency to a coil of the electric motor installed in the compressor without rotating the electric motor, and heating the compressor by Joule heat generated in the coil is also known.

However, because the compressor is heated in order to prevent flooding of the refrigerant in the compressor while the compressor is stopped, electric power is consumed even while the air-conditioning apparatus is stopped.

As a measure against this problem, in conventional technologies, a device that "detects an outside air temperature, changes the time of current applied or the level of voltage applied from an inverter device to a motor coil according to the outside air temperature, and controls so that the temperature of the compressor is kept at a substantially constant value regardless of the change in the outside air temperature" is proposed, for example (see Patent document 1, for example).

Also, a device "provided with saturation temperature calculating means that acquires the saturation temperature of a refrigerant in a compressor on the basis of a detected pressure by pressure detecting means; and control means that compares the acquired saturation temperature and the temperature detected by the temperature detecting means, determines a state in which the refrigerant is easily condensed, and controls the heater so as to heat the compressor when the compressor is stopped and the refrigerant in the compressor is in the state in which the refrigerant is easily condensed" is proposed (see Patent document 2, for example).

CITATION LIST

Patent Literature

Patent document 1: Japanese Unexamined Patent Application Publication No. 7-167504 (claim 1)

Patent document 2: Japanese Unexamined Patent Application Publication No. 2001-73952 (claim 1)

SUMMARY OF THE INVENTION

However, for the refrigerant to flood the compressor, a gas refrigerant in the compressor has to be condensed.

The condensation of the refrigerant occurs due to a temperature difference between a compressor shell and the refrigerant, when the temperature of the shell covering the compressor is lower than the refrigerant temperature in the compressor, for example.

On the contrary, if the compressor shell temperature is higher than the refrigerant temperature, the condensation of refrigerant does not occur, and the compressor does not have to be heated.

When the temperature of the compressor shell is higher than the refrigerant temperature, the refrigerant will not be condensed. However, as disclosed in Patent document 1, if the outside air is considered as representing the refrigerant temperature, in instances in which the outside temperature is higher than the temperature of the compressor shell and the temperature of the refrigerant is lower than the temperature of the compressor shell, even though there will be no flooding of the refrigerant in the compressor, the compressor will be heated and electric power will be wasted, disadvantageously.

Also, as described above, if the refrigerant floods the compressor, the concentration and the viscosity of the lubricant are decreased, and will raise the possibility of the sliding portion such as a rotation shaft or a compression portion of the compressor to be burned due to poor lubrication.

In order for such burning of the rotation shaft or the compression portion of the compressor to occur, the concentration of the lubricant oil actually has to be decreased to a predetermined value.

That is, if the amount of flooding refrigerant is not more than a predetermined value, it does not cause the concentration of the lubricant oil at which burning occurs in the compressor.

However, as disclosed in Patent document 2, if liquefaction of the refrigerant is determined from the refrigerant saturation temperature converted from the discharge temperature and the discharge pressure, the compressor is heated though the concentration of the lubricant oil is high and electric power is wasted, disadvantageously.

The present invention was made to solve the above problems and an objection thereof is to obtain an air-conditioning apparatus that can prevent condensation and flooding of a refrigerant in a compressor without excessively heating the compressor and can suppress power consumption while the air-conditioning apparatus is stopped.

The air-conditioning apparatus according to the present invention is provided with a refrigerant cycle, which circulates refrigerant, in which at least a compressor, a heat-source-side heat exchanger, expansion means, and a use-side heat exchanger are connected by a refrigerant pipeline, heating means to heat the compressor, and control means that obtains the refrigerant temperature in the compressor and controls the heating means on the basis of a change rate of the refrigerant temperature per a predetermined time. The control means starts a first heating operation when the compressor is in a stopped state and a change rate of the refrigerant temperature exceeds zero, sets heating capacity of the heating means to be in a range not more than an upper limit of the heating capacity on the basis of the change rate of the refrigerant temperature in the first heating operation. The control means acquires a remaining refrigerant liquid amount, which is a refrigerant which has not been evaporated even in the first heating operation, which has been condensed in the compressor, on the basis of the change rate of the refrigerant temperature and the heating capacity, starts a second heating operation when the compressor is in the stopped state and the change rate of the refrigerant temperature is not more than zero and further when the remaining refrigerant liquid amount exceeds zero, and controls the heating means on the basis of the remaining refrigerant liquid amount in the second heating operation so as to evaporate the condensed refrigerant in the compressor.

The present invention can prevent condensation and flooding of the refrigerant in the compressor without excessively heating the compressor and can suppress power consumption while the air-conditioning apparatus is stopped.

DESCRIPTION OF THE PREFERRED EMBODIMENTS

Embodiment 1

Entire Configuration

Figure 1:
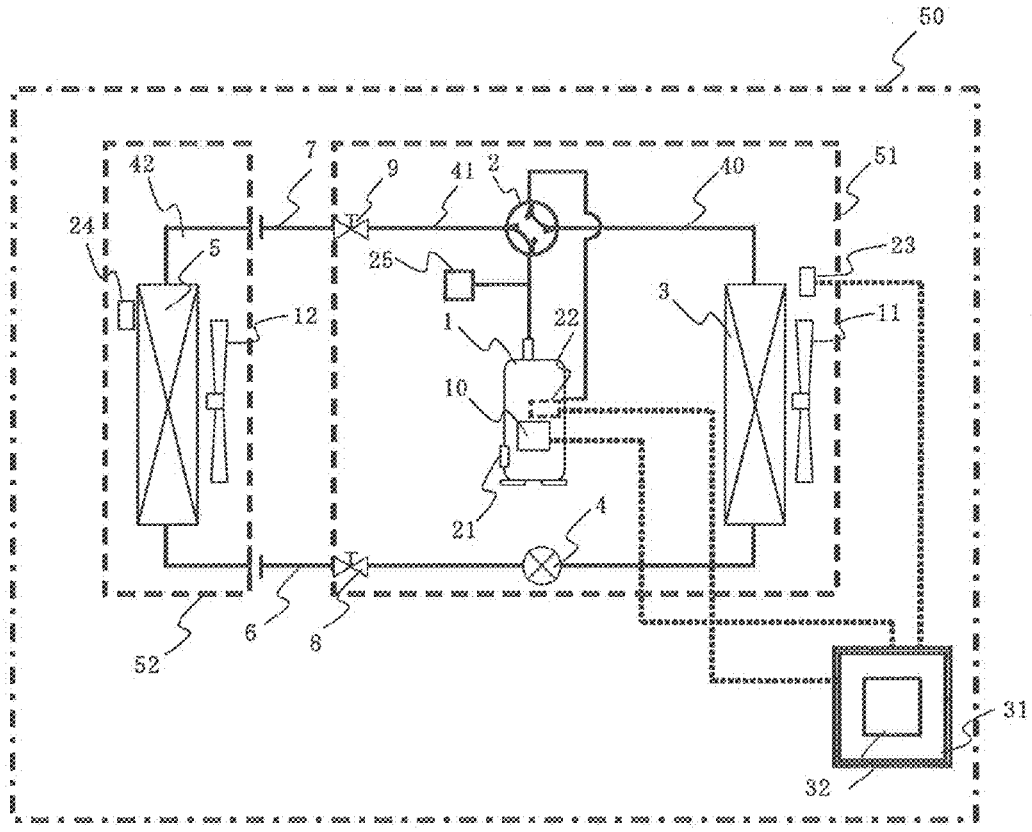
FIG. 1 is a refrigerant cycle diagram of an air-conditioning apparatus in Embodiment 1 of the present invention.

FIG. 1 is a refrigerant cycle diagram of an air-conditioning apparatus in Embodiment 1 of the present invention.

As illustrated in FIG. 1, an air-conditioning apparatus 50 is provided with a refrigerant cycle 40.

The refrigerant cycle 40 has an outdoor refrigerant cycle 41, which is a heat-source-side refrigerant cycle, and an indoor refrigerant cycle 42, which is a use-side refrigerant cycle, connected by a liquid-side connection pipeline 6 and a gas-side connection pipeline 7.

The outdoor refrigerant cycle 41 is contained in an outdoor unit 51 installed outdoors, for example.

In the outdoor unit 51, an outdoor fan 11 that supplies outside air to the outside unit 51 is provided.

The indoor refrigerant cycle 42 is contained in an indoor unit 52 installed indoors, for example.

In the indoor unit 52, an indoor fan 12 that supplies indoor air to the indoor unit 52 is provided.

[Configuration of Outdoor Refrigerant Cycle]

The outdoor refrigerant cycle 41 is provided with a compressor 1, a four-way valve 2, an outdoor heat exchanger 3, an expansion valve 4, a liquid-side stop valve 8, and a gas-side stop valve 9, which are connected sequentially by a refrigerant pipeline.

The liquid-side stop valve 8 is connected to the liquid-side connection pipeline 6. The gas-side stop valve 9 is connected to the gas-side connection pipeline 7. After the air-conditioning apparatus 50 is installed, the liquid-side stop valve 8 and the gas-side stop valve 9 are in the open state.

The "outdoor heat exchanger 3" corresponds to the "heat-source-side heat exchanger" in the present invention.

The "expansion valve 4" corresponds to the "expanding means" in the present invention.

[Configuration of Indoor Refrigerant Cycle]

The indoor refrigerant cycle 42 is provided with an indoor heat exchanger 5.

One end of the indoor refrigerant cycle 42 is connected to the liquid-side stop valve 8 through the liquid-side connection pipeline 6, while the other end is connected to the gas-side stop valve 9 through the gas-side connection pipeline 7.

The "indoor heat exchanger 5" corresponds to the "use-side heat exchanger" in the present invention.

[Description of Compressor]

Figure 2:
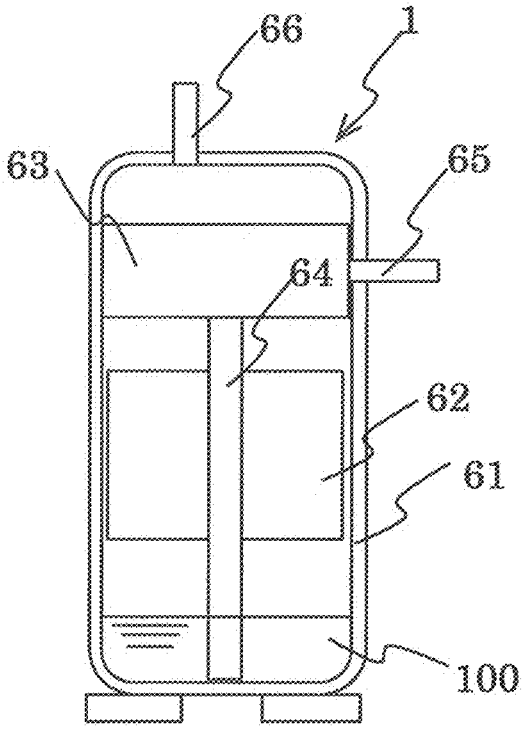
FIG. 2 is a simplified internal structural diagram of a compressor in Embodiment 1 of the present invention.

FIG. 2 is a simplified internal structural diagram of the compressor in Embodiment 1 of the present invention.

The compressor 1 is constituted by a hermetic compressor as illustrated in FIG. 2, for example. The outer shell of the compressor 1 is constituted by a compressor shell portion 61.

The compressor shell portion 61 contains an electric motor portion 62 and a compression portion 63.

In the compressor 1, a sucking portion 66 that sucks the refrigerant into the compressor 1 is provided.

Also, in the compressor 1, a discharge portion 65 that discharges the refrigerant after compression is provided.

The refrigerant sucked through the sucking portion 66 is sucked into the compression portion 63 and then, compressed. The refrigerant compressed in the compression portion 63 is temporarily released into the compressor shell portion 61. The refrigerant discharged into the compressor shell portion 61 is fed out to the refrigerant cycle 40 through the discharge portion 65. At this time, the inside of the compressor 1 has high pressure.

[Description of Compressor Motor]

The electric motor portion 62 of the compressor 1 is constituted by a three-phase motor, for example, and electric power is supplied through an inverter which is not shown.

When an output frequency of the inverter changes, the rotation speed of the electric motor portion 62 changes, and a compression volume of the compression portion 63 changes.

[Description of Air-Heat Exchanger]

The outdoor heat exchanger 3 and the indoor heat exchanger 5 are fin-and-tube type heat exchangers, for example.

The outdoor heat exchanger 3 exchanges heat between outside air supplied from the outdoor fan 11 and the refrigerant in the refrigerant cycle 40.

The indoor heat exchanger 5 exchanges heat between indoor air supplied from the indoor fan 12 and the refrigerant in the refrigerant cycle 40.

[Description of Four-Way Valve]

The four-way valve 2 is used for switching the flow of the refrigerant cycle 40.

If there is no need to switch the flow of the refrigerant or if the air-conditioning apparatus 50 is used exclusively for cooling or exclusively for heating, for example, the four-way valve 2 becomes unnecessary and can be removed from the refrigerant cycle 40.

[Description of Sensors]

In the air-conditioning apparatus 50, a temperature or pressure sensor is provided as necessary.

In FIG. 1, a compressor temperature sensor 21, a refrigerant temperature sensor 22, an outside air temperature sensor 23, an indoor temperature sensor 24, and a pressure sensor 25 are provided.

The compressor temperature sensor 21 detects the temperature (hereinafter referred to as a "compressor shell temperature") of the compressor 1 (compressor shell portion 61).

The refrigerant temperature sensor 22 detects the refrigerant temperature in the compressor 1.

The outdoor temperature sensor 23 detects the temperature (hereinafter referred to as an "outdoor air temperature") of air that is heat-exchanged with the refrigerant at the outdoor heat exchanger 3.

The indoor temperature sensor 24 detects the temperature (hereinafter referred to as an "indoor air temperature") of air that is heat-exchanged with the refrigerant at an outdoor heat exchanger 5.

The pressure sensor 25 is provided in a pipeline on the refrigerant sucking side of the compressor 1, for example, and detects a refrigerant pressure in the refrigerant cycle 40.

The arrangement position of the pressure sensor is not limited to the above. The pressure sensor 25 may be arranged at an arbitrary position in the refrigerant cycle 40.

The "compressor shell temperature" corresponds to the "temperature of the compressor" in the present invention.

[Description of Controller]

The detected values of the sensors are input to a controller 31 which executes control operation of the air-conditioning apparatus such as capacity control of the compressor and heating control of a compressor heating portion 10, which will be described later, for example.

Also, the controller 31 is provided with a calculating device 32.

The calculating device 32 computes a change rate of the refrigerant temperature per a predetermined time (hereinafter referred to as a "change rate of a refrigerant temperature") by using a detected value of the compressor temperature sensor 21. Also, the calculating device 32 has a storage device (not shown) that stores a refrigerant temperature obtained the predetermined time earlier to be used for the calculation and a timer or the like (not shown) that measures the elapse of the predetermined time.

The controller 31 adjusts the heating capacity of the compressor heating portion 10 by using a calculated value calculated by the calculating device 32, the details of which will be described later.

The "controller 31" and the "calculating device 32" correspond to "control means" in the present invention.

[Description of Compressor Heating Portion]

The compressor heating portion 10 heats the compressor 1.

As for the compressor heating portion 10, the heating capacity (electric power) for heating the compressor 1 is set in a range not more than a predetermined upper limit value by the controller 31.

This compressor heating portion 10 can be constituted by the electric motor portion 62 of the compressor 1, for example. In this case, the controller 31 supplies electricity to the electric motor portion 62 of the compressor 1 in an open-phase state while the air-conditioning apparatus 50 is stopped, that is, while the compressor 1 is stopped. As a result, the electric motor portion 62 supplied with electricity in the open-phase state does not rotate, and the current flowing through the coil generates Joule heat, whereby the compressor 1 is heated. That is, while the air-conditioning apparatus 50 is stopped, the electric motor portion 62 turns into the compressor heating portion 10.

The compressor heating portion 10 may be anything as long as it heats the compressor 1 and is not limited to the above. An electric heater, for example, may be provided separately.

The "compressor heating portion 10" corresponds to the "heating means" in the present invention.

Subsequently, the principle of the refrigerant flooding the compressor 1 while the air-conditioning apparatus 50 is stopped and the advantages of heating the compressor 1 will be described.

[Description of Principle of Refrigerant Stagnation in Compressor 1]

While the air-conditioning apparatus 50 is stopped, the refrigerant in the refrigerant cycle 40 condenses and floods a portion where the temperature is the lowest among the constituent elements.

Thus, if the temperature of the compressor 1 is lower than the temperature of the refrigerant, the refrigerant is likely to flood the compressor 1.

[Description of Refrigerant Stagnation Principle in Compressor 2]

The compressor 1 is a hermetic compressor as illustrated in FIG. 2, for example. In the compressor 1, lubricant oil 100 is stored.

The lubricant oil 100 is provided to the compression portion 63 and a rotation shaft 64 when the compressor 1 is operated, and is used for lubrication.

When the refrigerant is condensed and floods the compressor 1, the refrigerant dissolves in the lubricant oil 100, whereby the concentration of the lubricant oil 100 is decreased, and the viscosity is also decreased.

If the compressor 1 is started in this state, the lubricant oil 100 with low viscosity will be provided to the compression portion 63 and the rotation shaft 64, raising the possibility of the compression portion 63 and the rotation shaft 64 being burned due to poor lubrication.

Also, when the liquid level in the compressor increases by the flooding of the refrigerant, a start load of the compressor 1 becomes higher, which is regarded as an overcurrent at the start of the air-conditioning apparatus 50, and the air-conditioning apparatus 50 might not be able to be started.

[Description of Advantages of Compressor Heating]

Thus, by heating the compressor 1 by operating the compressor heating portion 10 using the controller 31 while the air-conditioning apparatus 50 is stopped, evaporation of the liquid refrigerant dissolved in the lubricant oil 100 in the compressor 1 can decrease the refrigerant amount dissolved in the lubricant oil 100.

Also, by heating the compressor so that the compressor shell temperature is maintained higher than the refrigerant temperature, condensation of refrigerant in the compressor 1 can be prevented, and drop of concentration of the lubricant oil 100 can be suppressed.

Figure 3:
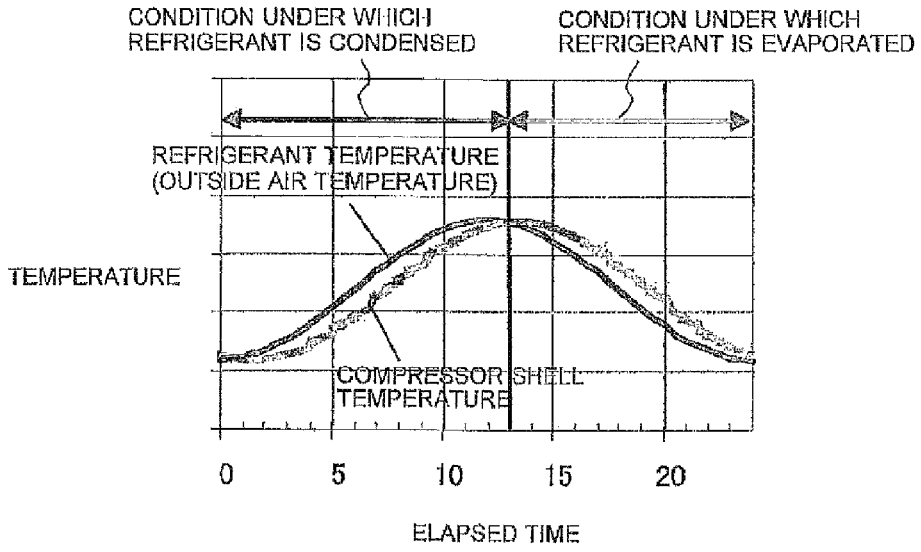
FIG. 3 is a graph illustrating a relationship between a refrigerant temperature and a compressor shell temperature in Embodiment 1 of the present invention.

FIG. 3 is a graph illustrating a relationship between the refrigerant temperature and the compressor shell temperature in Embodiment 1 of the present invention.

As illustrated in FIG. 3, when the refrigerant temperature changes, the compressor shell temperature also changes accordingly.

The change in the compressor shell temperature occurs subsequent to that of the refrigerant temperature due to the heat capacity of the compressor 1.

Also, the condensation amount of the gas refrigerant present in the compressor 1 differs depending on the temperature difference between the refrigerant temperature and the compressor shell temperature as well as the time period over which the temperature difference lasts.

That is, the more the compressor shell temperature is low compared to the refrigerant temperature and the more the temperature difference is large, the larger the condensation heat amount is, and thus, the heating amount for the compressor 1 in order to prevent the refrigerant from condensing becomes larger.

On the other hand, if the difference between the refrigerant temperature and the compressor shell temperature is small, the condensation amount of condensation in the compressor 1 is small, and thus, the heating amount for the compressor 1 can be small.

The change in the compressor shell temperature of the compressor 1 is affected by the heat capacity of the compressor 1, and by grasping the relationship between the change rate of the refrigerant temperature and the condensation liquid amount in the compressor 1 in advance, a required heating capacity can be determined from the amount of change of the refrigerant temperature in a predetermined time.

That is, since the compressor 1 is not heated excessively by increasing and decreasing the heating capacity of the compressor 1 that is proportionate to the change rate of the refrigerant temperature with the controller 31 and the calculating device 32, power consumption while the air-conditioning apparatus 50 is stopped can be suppressed.

Subsequently, a relationship between the change rate of the refrigerant temperature in the compressor 1 and the heating capacity required to prevent condensation of refrigerant in the compressor 1 will be described.

[Relationship Between Refrigerant Temperature Change Rate and a Required Heating Capacity]

First, a relationship of a refrigerant temperature Tr in the compressor 1, a compressor shell temperature Ts of the compressor 1, and a liquid refrigerant amount Mr in the compressor 1 will be described.

Here, stagnation of the refrigerant in the compressor 1 is assumed, and the compressor shell temperature Ts is assumed to be lower than the refrigerant temperature Tr.

A relationship among a heat exchange amount Qr (condensation capacity) of the compressor 1 required for the refrigerant in the compressor 1 to condense, the refrigerant temperature Tr, and the compressor shell temperature Ts is expressed as expression (1).

$$Qr=A\cdot K\cdot(Tr-Ts) \tag{1}$$

Here, A designates an area heat-exchanged between the compressor 1 and the refrigerant in the compressor 1. K designates a coefficient of overall heat transmission between the compressor 1 and the refrigerant in the compressor 1.

On the other hand, since the refrigerant in the compressor 1 is condensed by the temperature difference between the compressor shell temperature Ts and the refrigerant temperature Tr, a relationship between the heat exchange amount Qr and a liquid refrigerant amount change dMr at a predetermined time dt is expressed as expression (2).

$$Qr=dMr\times dH/dt \tag{2}$$

Here, dH designates latent heat of evaporation of the refrigerant.

From the expression (1) and the expression (2), the relationship of the liquid refrigerant amount change dMr in the compressor 1, the refrigerant temperature Tr, and the compressor shell temperature Ys in a certain change of time (predetermined time dt) is expressed by the expression (3).

$$dMr/dt=C1\cdot(Tr-Ts) \tag{3}$$

Assuming that the state Ts<Tr continued from time t1 (liquid refrigerant amount Mr1) to t2 (liquid refrigerant amount Mr2), from the expression (3), the liquid refrigerant amount change dMr (=MR2−Mr1) condensed in the compressor 1 is expressed by the expression (4).

$$dMr = Mr2 - Mr1 = \int_{t1}^{t2} (C1\cdot(T_{r(t)} - T_{s(t)}))\cdot dt \tag{4}$$

Here, C1 is a fixed value and is a value obtained by dividing a heat transfer area A and a coefficient of overall heat transmission K by the latent heat of evaporation dH.

If radiation and heat absorption amounts in the compressor shell portion 61 of the compressor 1 can be disregarded, the compressor shell temperature is depends on the refrigerant temperature Tr and is determined by the heat capacity of the compressor shell portion 61.

That is, Tr−Ts depends on the amount of change dTr of the refrigerant temperature Tr. Thus, if the change of the refrigerant temperature Tr changes from a certain temperature by dTr and becomes stable, the liquid refrigerant amount change dMr can be expressed by the expression (5).

$$dMr=C2\cdot dTr \tag{5}$$

Here, C2 is a proportionality constant that can be acquired by test results or theoretical calculation.

From the expression (2) and the expression (5), the heat exchange amount Qr of the compressor 1 can be expressed by the expression (6).

$$Qr=C2\cdot dH\cdot dTr/dt \tag{6}$$

Figure 4:
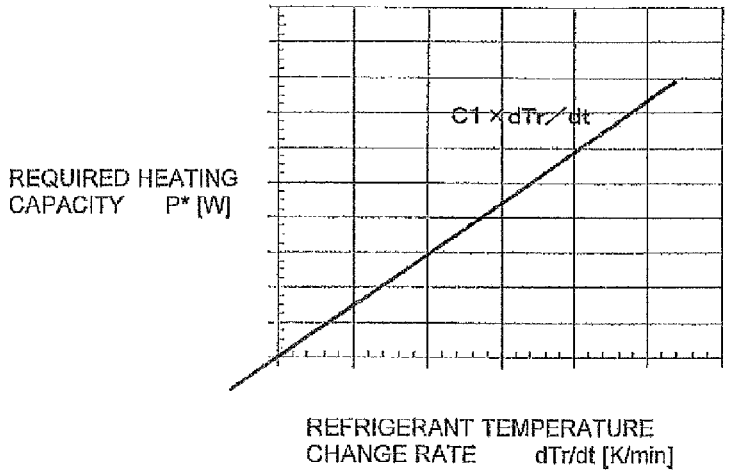
FIG. 4 is a graph illustrating a relationship between a change rate of a refrigerant temperature and a required heating capacity in Embodiment 1 of the present invention.

FIG. 4 is a graph illustrating a relationship between the change rate of the refrigerant temperature and the required heating capacity in Embodiment 1 of the present invention.

In order to prevent condensation of the refrigerant in the compressor 1, it is only necessary to supply the amount of heat matching the heat exchange amount Qr (condensation capacity) of the compressor 1 during the refrigerant temperature Tr changes.

A required heating capacity P* required to obtain the heating amount at this time has a relationship as the expression (7).

That is, as illustrated in FIG. 4, the required heating capacity P* is proportionate to the change rate of the refrigerant temperature (dTr/dt), which is a ratio between the amount of change dTr of the refrigerant temperature Tr and the predetermined time dt.

$$Ph \propto C2 \cdot dH \cdot (dTr/dt) \quad (7)$$

That is, if the change rate of the refrigerant temperature (dTr/dt) is large, the heat exchange amount Qr (condensation capacity) of the compressor 1 becomes large, and thus, the required heating capacity P* increases.

On the contrary, if the change rate of the refrigerant temperature (dTr/dt) is small, the heat exchange amount Qr (condensation capacity) of the compressor 1 becomes small, and the required heating capacity P* decreases.

As described above, the heating capacity to be provided to the compressor 1 required to prevent condensation of refrigerant in the compressor 1 can be determined from the change rate of the refrigerant temperature (dTr/dt).

[Alternative of Refrigerant Temperature]

As described above, by using the refrigerant temperature Tr in the compressor 1, the required heating capacity P* can be acquired. However, the refrigerant temperature sensor 22 needs to be separately provided. Also, since the refrigerant temperature has a large amount of temperature change, if the refrigerant temperature sensor 22 is constituted by a thermistor, for example, resolution is low at a low temperature zone, and a measurement error might occur.

Here, since the outdoor heat exchanger 3 and the indoor heat exchanger 5 are heat exchangers that exchanges heat between the refrigerant and the air, surface area in contact with the air is large.

Also, the outdoor heat exchanger 3 and the indoor heat exchanger 5 are formed of a member made of metal having relatively high heat conductivity such as aluminum and copper, for example, and its heat capacity is relatively small.

For example, if the surface area of the outdoor heat exchanger 3 is larger than that of the indoor heat exchanger 5 and the heat capacity of the outdoor heat exchanger 3 is larger than the heat capacity of the indoor heat exchanger 5, when the outside air temperature changes, the refrigerant temperature also changes almost at the same time. That is, the refrigerant temperature changes substantially similarly to the outside air temperature.

From the above facts, if it is so configured that the heat capacity of the outdoor heat exchanger 3 is larger than the heat capacity of the indoor heat exchanger 5, while the compressor 1 is stopped, the detected value of the outside air temperature sensor 23 can be used alternative to the refrigerant temperature Tr.

Also, if the surface area of the indoor heat exchanger 5 is larger than that of the outdoor heat exchanger 3 and the heat capacity of the indoor heat exchanger 5 is larger than the heat capacity of the outdoor heat exchanger 3, when the indoor temperature changes, the refrigerant temperature also changes almost at the same time. That is, the refrigerant temperature changes substantially similarly to the indoor temperature.

From the above, if it is so configured that the heat capacity of the indoor heat exchanger 5 is larger than the heat capacity of the outdoor heat exchanger 3, while the compressor 1 is stopped, the detected value of the indoor temperature sensor 24 can be used alternative to the refrigerant temperature Tr.

As described above, by using the detected value of the outside air temperature sensor 23 or the indoor temperature sensor 24, the refrigerant temperature sensor 22 that detects the refrigerant temperature in the compressor 1 is no longer needed and can be removed from the refrigerant cycle 40.

Thus, by using an outside air temperature sensor or an indoor temperature sensor mounted on a general air-conditioning apparatus, the heating amount for the compressor 1 can be acquired, and the heating amount can be calculated without complicating the configuration.

In this embodiment, a configuration in which the heat capacity of the outdoor heat exchanger 3 is larger than the heat capacity of the indoor heat exchanger 5 and an outside air temperature Ta is used instead of the refrigerant temperature Tr will be described.

That is, the liquid refrigerant amount change dMr [kg] in the above expression (5) can be expressed by the expression (8) by using the amount of change dTa [degree C] of the outside air temperature Ta [degree C] in the predetermined time dt [s].

$$dMr = \alpha \cdot dTa \quad (8)$$

here, a denotes α proportionality constant that can be acquired by test results or theoretical calculation.

Also, from the expression (2) and the expression (8), the heat exchange amount Qr [W] of the compressor 1 can be expressed by the expression (9).

$$Qr = \alpha \cdot dH \cdot dTa/dt \quad (9)$$

here, dH denotes latent heat of evaporation [J/kg] of the refrigerant.

Also, the required heating capacity P* [W] can be expressed by the expression (10) by using the outside air temperature change rate Tah (dTa/dt), which is a ratio between the amount of change dTa of the outside air temperature Ta and the predetermined time dt.

$$P^* = Qr = \alpha \cdot dH \cdot Tah \quad (10)$$

Considering heat loss of the compressor 1, the required heating capacity P* may be divided by a predetermined contribution rate of temperature rise of the compressor fhcomp [%].

The "outside air temperature change rate Tah" in this embodiment is synonymous with the "refrigerant temperature change rate" in the present invention.

[Description of Refrigerant Stagnation Caused by Insufficient Heating Capacity]

As described above, in order to prevent condensation of the refrigerant in the compressor 1, it is only necessary to supply the heating capacity (electric power) more than the required heating capacity P* to the compressor 1.

However, the heating capacity (electric power) that can be provided from the compressor heating portion 10 to the compressor 1 is, in fact, limited.

Thus, if the required heating capacity P* exceeds the upper limit of the heating capacity of the compressor heating portion 10 (hereinafter referred to as a "heating capacity upper limit Pmax"), the refrigerant is condensed in the compressor 1 by the portion of deficiency of the heating capacity.

Here, it is assumed that the required heating capacity P* (i) in the predetermined time dt has exceeded the heating capacity upper limit Pmax. An estimated condensation liquid amount ΔMs(i), which is a refrigerant amount condensed in the compressor 1 in this predetermined time dt, is expressed by the expression (11), assuming that the heating capacity of the compressor heating portion 10 is the heating capacity upper limit Pmax.

$$\Delta Ms_{(i)} = \frac{(P^*_{(i)} - P\max) \cdot dt}{dH} \quad (11)$$

Here, dH denotes the latent heat of evaporation [J/kg].

Also, assuming that the heating capacity of the compressor heating portion 10 in the predetermined time dt is Ph (<heating capacity upper limit Pmax), the estimated condensed liquid amount ΔMs(i) is expressed by the expression (12).

$$\Delta Ms_{(i)} = \frac{(P^*_{(i)} - Ph) \cdot dt}{dH} \quad (12)$$

From the expression (11) or the expression (12), the remaining refrigerant liquid amount Ms, which is a refrigerant amount condensed in the compressor 1 that had not been evaporated due to insufficient heating capacity, is expressed by the expression (13).

$$Ms = \Sigma \Delta Ms_{(i)} \quad (13)$$

In order to prevent condensation of refrigerant in the compressor 1, the heating amount for evaporating this remaining refrigerant liquid amount Ms needs to be provided to the compressor 1.

Subsequently, a heating operation of the compressor 1 in this embodiment preventing condensation and flooding of the refrigerant in the compressor 1 without excessive heating of the compressor 1 will be described.

[Description of Heating Operation]

Figure 5:
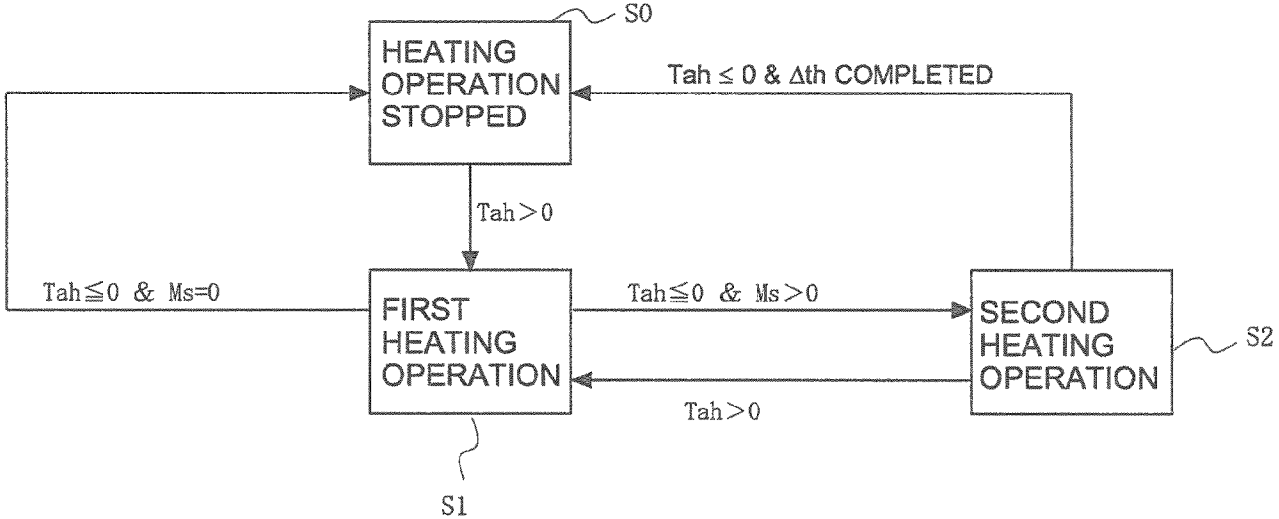
FIG. 5 is a diagram illustrating a transition of a heating operation in Embodiment 1 of the present invention.

FIG. 5 is a diagram illustrating a transition of the heating operation in Embodiment 1 of the present invention.

First, on the basis of each step in FIG. 5, the transition of the heating operation of the compressor 1 in this embodiment will be described.

(S0)

The controller 31 calculates the outside air temperature change rate Tah while the air-conditioning apparatus 50 is stopped (a state in which the compressor 1 is stopped).

(S1)

The controller 31 starts the first heating operation if the outside air temperature change rate Tah exceeds zero when the compressor 1 is in the stopped state.

In the first heating operation, the controller 31 sets the heating capacity of the compressor heating portion 10 on the basis of the outside air temperature change rate Tah in a range not exceeding the heating capacity upper limit Pmax so as to conduct heating of the compressor 1.

Further, the controller 31 acquires the remaining refrigerant liquid amount Ms, which is a refrigerant amount condensed in the compressor 1 that had not been evaporated even in the first heating operation, on the basis of the outside air temperature change rate Tah and the set value of the heating capacity of the compressor heating portion 10.

If the outside air temperature change rate Tah becomes zero or below during the first heating operation and the remaining refrigerant liquid amount Ms becomes zero, the controller 31 stops the heating operation (S0).

(S2)

On the other hand, if the outside air temperature change rate Tah becomes zero or below during the first heating operation and the remaining refrigerant liquid amount Ms exceeds zero, the controller 31 starts a second heating operation.

During the second heating operation, the controller 31 controls the compressor heating portion 10 on the basis of the remaining refrigerant liquid amount Ms and makes the refrigerant condensed in the compressor 1 to evaporate.

If the outside air temperature change rate Tah is zero or below and also, an assist heating time Δth, which will be described later, has elapsed, the controller 31 stops the heating operation (S0).

On the other hand, if the outside air temperature change rate Tah exceeds zero during the second heating operation, the first heating operation is started (S1).

By means of such operation, in the first heating operation, condensation of the refrigerant can be prevented without excessively heating the compressor 1. Also, the condensed refrigerant that had not been evaporated in the first heating operation due to insufficient heating capacity can be evaporated in the second heating operation.

Subsequently, details of the calculating operation of the outside air temperature change rate Tah and the first and second heating operations will be described.

[Outside Air Temperature Change Rate Tah Calculating Operation]

Figure 6:
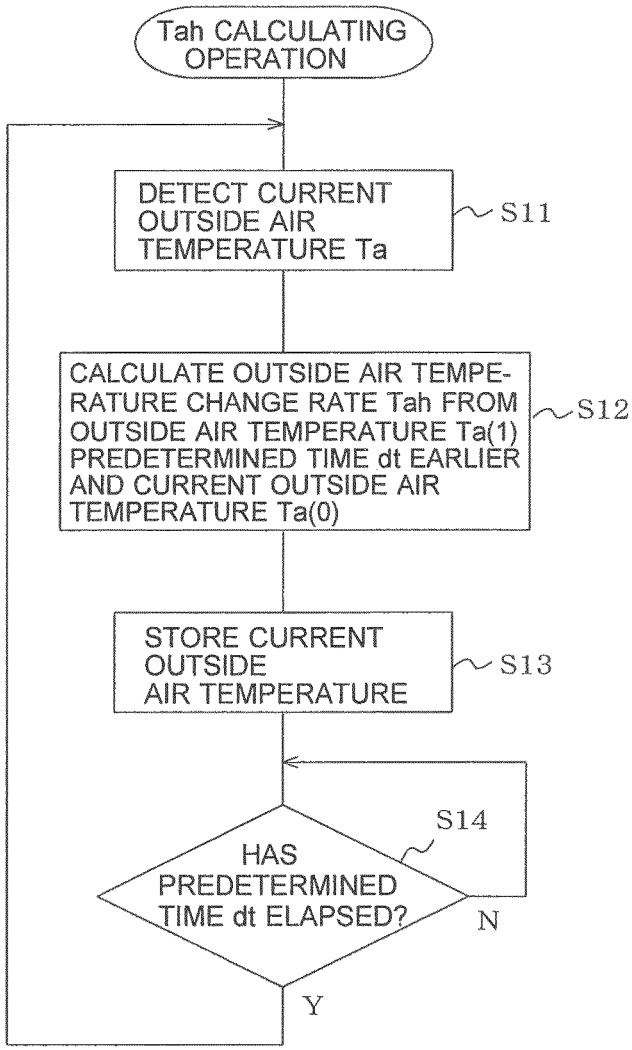
FIG. 6 is a flowchart illustrating a calculating operation of a change rate of outside air temperature in Embodiment 1 of the present invention.

FIG. 6 is a flowchart illustrating the calculating operation of the outside air temperature change rate in Embodiment 1 of the present invention.

First, the calculating operation of the outside air temperature change rate Tah will be described on the basis of each step in FIG. 6.

(S11)

The controller 31 detects the current outside air temperature Ta by using the outside air temperature sensor 23 while the air-conditioning apparatus 50 is stopped.

(S12)

The calculating device 32 of the controller 31 calculates the outside air temperature change rate Tah (=(dTa/dt)=(Ta(0)−Ta(1))/dt) by using the detected current outside air temperature Ta(0) and the outside air temperature Ta(1) (which will be described later) stored the predetermined time dt earlier.

In cases such as the start of the operation, in which the outside air temperature Ta(0) the predetermined time dt earlier is not stored, Step S12 is omitted, and the routine proceeds to Step S13.

(S13)

The controller 31 stores the current outside air temperature Ta in the storage device mounted on the calculating device 32.

(S14)

The controller 31 measures the elapse of the predetermined time Dt with a timer or the like mounted on the calculating device 32 and after the predetermined time dt has elapsed, the routine returns to Step S11, and the above step is repeated.

Through the above operations, the outside air temperature change rate Tah is calculated in every predetermined time dt.

Subsequently, the details of the first heating operation will be described.

[First Heating Operation]

<Starting Condition>

If all the following conditions are satisfied (logical product), the first heating operation is started.

(a) The compressor 1 is in the stopped state (b) Tah>0

<Contents of Heating Control>

Figure 7:
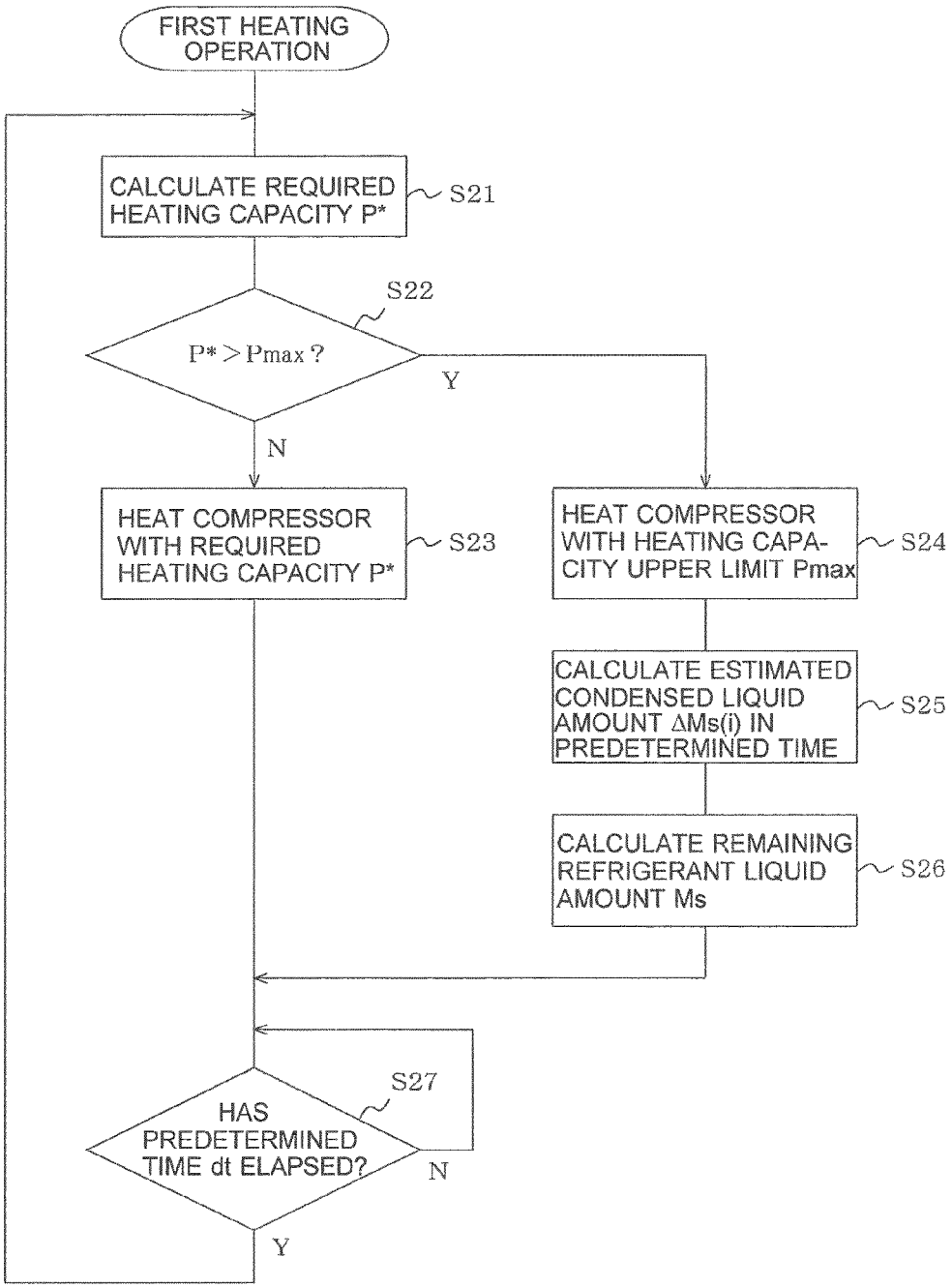
FIG. 7 is a flowchart illustrating a first heating operation in Embodiment 1 of the present invention.

FIG. 7 is a flowchart illustrating the first heating operation in Embodiment 1 of the present invention.

The operation will be described on the basis of each step in FIG. 7.

(S21)

The calculating device 32 of the controller 31 acquires the required heating capacity P* that is proportionate to the current outside air temperature change rate Tah.

The required heating capacity P* is calculated by applying the current outside air temperature change rate Tah to the above expression (10).

It can be also calculated by, for example, multiplying the current outside air temperature change rate Tah by a predetermined coefficient set in advance.

(S22)

The controller 31 determines whether or not the calculated required heating capacity P* is larger than the heating capacity upper limit Pmax set in advance.

If the required heating capacity P* is not more than the heating capacity upper limit Pmax, the routine proceeds to Step S23.

If the required heating capacity P* is larger than the heating capacity upper limit Pmax, the routine proceeds to Step S24.

(S23)

The controller 31 sets the heating capacity of the compressor heating portion 10 to the calculated required heating capacity P* and performs heating of the compressor 1 for the predetermined heating time (=predetermined time dt).

Here, the predetermined time dt is used as the predetermined heating time, but the present invention is not limited to that. For example, time shorter than the predetermined time dt may be used as the heating time, and large heating capacity (≤heating capacity upper limit Pmax) may be provided in a short time, or the heating capacity may be increased/decreased in steps. That is, it is only necessary that an integrated value of the heating capacity in the predetermined time dt matches the required heating capacity P*×predetermined time dt.

(S24)

On the other hand, if the required heating capacity P* is larger than the heating capacity upper limit Pmax, the controller 31 sets the heating capacity of the compressor heating portion 10 to the heating capacity upper limit Pmax and performs heating of the compressor 1 for the predetermined heating time (=predetermined time dt).

Here, the heating capacity of the compressor heating portion 10 is set to the heating capacity upper limit Pmax, but the present invention is not limited to that. For example, the controller 31 may set the heating capacity of the compressor heating portion 10 to an arbitrary value not more than the heating capacity upper limit Pmax and perform heating of the compressor 1 for the predetermined heating time (=predetermined time dt).

(S25)

The calculating device 32 of the controller 31 applies the heating capacity of the compressor heating portion 10 (=heating capacity upper limit Pmax) and the required heating capacity P* calculated at Step S21 to the above expression (11) and calculates the estimated condensed liquid amount ΔMs(i) condensed in the compressor 1 in the predetermined time dt.

If heating capacity Ph not more than the heating capacity upper limit Pmax is set at Step S24, the expression (12) is applied, and the estimated condensed liquid amount ΔMs(i) is calculated.

That is, the estimated condensed liquid amount ΔMs(i) is calculated on the basis of a difference between the required heating capacity P*, calculated on the basis of the current outside air temperature change rate Tah, and the current heating capacity of the compressor heating portion 10.

(S26)

The calculating device 32 of the controller 31 integrates the current estimated condensed liquid amount ΔMs(i) by the expression (13) and calculates the remaining refrigerant liquid amount Ms, which is the total of the refrigerant amount condensed in the compressor 1 that had not been evaporated even in the first heating operation.

The controller 31 stores the calculated remaining refrigerant liquid amount Ms in the storage device mounted on the calculating device 32.

(S27)

The controller 31 measures the elapse of the predetermined time Dt with a timer or the like mounted on the calculating device 32 and after the predetermined time dt has elapsed, the routine returns to Step S21, and the above step is repeated.

<Ending Condition>

If either of the following conditions is satisfied (logical sum), the first heating operation is ended.

(a) Tah≤0

(b) If the compressor 1 is started

Subsequently details of the second heating operation will be described.

[Second Heating Operation]

<Starting Condition>

If all the following conditions are satisfied (logical product), the second heating operation is started.

(a) The compressor 1 is in the stopped state (b) Tah≤0

(c) Remaining refrigerant liquid amount Ms>0

<Contents of Heating Control>

Figure 8:
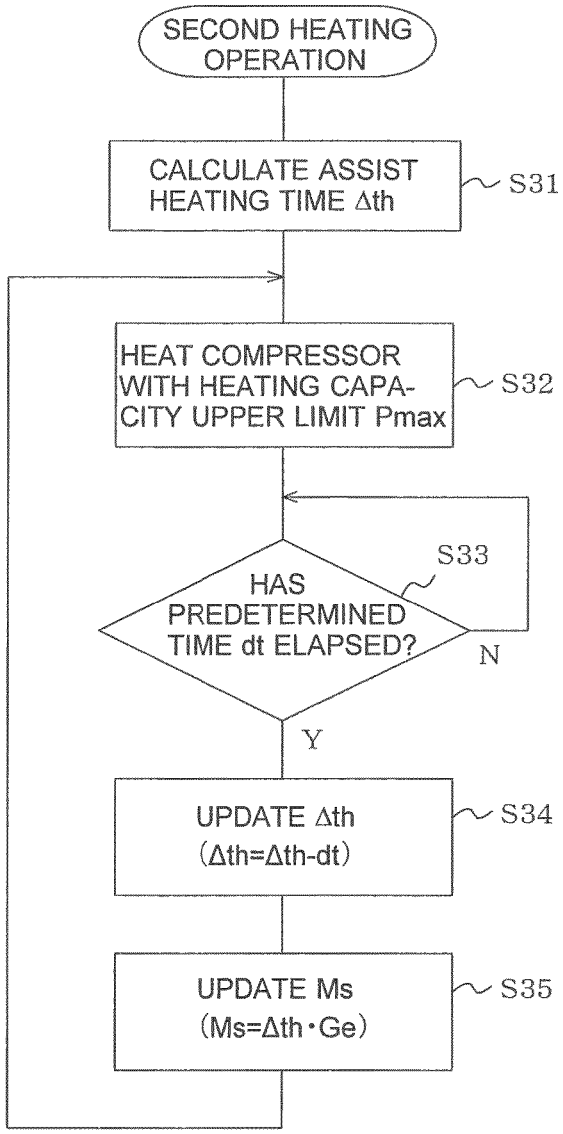
FIG. 8 is a flowchart illustrating a second heating operation in Embodiment 1 of the present invention.

FIG. 8 is a flowchart illustrating the second heating operation in Embodiment 1 of the present invention.

The operation will be described on the basis of each step in FIG. 8.

(S31)

The calculating device 32 of the controller 31 acquires an assist heating time Δth, which is time required for the remaining refrigerant liquid amount Ms to evaporate, on the basis of the remaining refrigerant liquid amount Ms when the compressor heating portion 10 is at a predetermined heating capacity.

The controller 31 stores the assist heating time Δth in the storage device mounted on the calculating device 32.

This assist heating time Δth [s] can be acquired by the expression (14) by using an evaporation flow rate Ge [kg/s] at a predetermined heating capacity.

$$\Delta th = Ms/Ge \tag{14}$$

Here, the evaporation flow rate Ge is a constant determined from the heating capacity of the compressor shell portion 61 of the compressor 1, the heating capacity of the compressor heating portion 10 and the like and can be acquired by test results or theoretical calculation.

In this embodiment, the heating capacity upper limit Pmax, for example, is used for the predetermined heating capacity.

The present invention is not limited to that, and the heating capacity may be arbitrary but not more than the heating capacity upper limit Pmax.

That is, by using the evaporation flow rate Ge according to the set heating capacity, the assist heating time Δth required for the remaining refrigerant liquid amount Ms to evaporate can be acquired.

(S32)

The controller 31 sets the heating capacity of the compressor heating portion 10 to the heating capacity upper limit Pmax and performs heating of the compressor 1 for the predetermined heating time (=predetermined time dt).

Here, the heating capacity of the compressor heating portion 10 is set to the heating capacity upper limit Pmax, but the present invention is not limited to that. For example, the controller 31 may calculate the assist heating time Δth with the arbitrary heating capacity not more than the heating capacity upper limit Pmax at Step S31 and perform heating of the compressor 1 with the arbitrary heating capacity.

(S33)

The controller 31 measures the elapse of the predetermined time Dt with a timer or the like mounted on the calculating device 32 and after the predetermined time dt has elapsed, the routine proceeds to Step S34.

(S34)

The calculating device 32 of the controller 31 subtracts the predetermined time dt from the current assist heating time Δth and updates the assist heating time Δth.

(S35)

The calculating device 32 of the controller 31 acquires the current remaining refrigerant liquid amount Ms after the heating and updates the value of the remaining refrigerant liquid amount Ms stored in the storage device, and the routine returns to the Step S32, and the step is repeated.

The current remaining refrigerant liquid amount Ms can be acquired by the expression (14), the updated assist heating time Δth, and the expression (15).

$$\text{Current } MS = \text{Updated } \Delta th \cdot Ge \quad (15)$$

<Ending Condition>

If any of the following conditions is satisfied (logical sum), the second heating operation is ended.

(a) Tah>0

(b) If the compressor 1 is started (c) Updated assist heating time Δth≤0

That is, in the state in which the compressor 1 is stopped and Tah≤0, the compressor heating portion 10 is set to the predetermined heating capacity (=heating capacity upper limit Pmax) and the compressor 1 is heated until the assist heating time Δth has elapsed.

On the other hand if the above (a) is satisfied while the compressor 1 is stopped, the starting condition of the first heating operation is satisfied, and the routine proceeds to the first heating operation. At this time, the value of the updated remaining refrigerant liquid amount Ms stored in the storage device is maintained.

Then, if heating is not sufficient in the first heating operation, the estimated condensation liquid amount ΔMs(i) is integrated with the updated remaining refrigerant liquid amount Ms.

When the routine transits to the first heating operation, it may be so configured that the updated assist heating time Δth is maintained, and the maintained assist heating time Δth is used when the second heating operation is performed.

As a result, even if the heating operation has been transited, the remaining refrigerant liquid amount Ms condensed in the compressor 1 can be evaporated.

Also, if the above (b) is satisfied, the controller 31 sets the values of the remaining refrigerant liquid amount Ms and the assist heating time Δth to zero.

This is because the refrigerant temperature will be raised by the operation of the compressor 1 and the refrigerant stagnating in the compressor 1 will be evaporated.

Subsequently, an example of the result of the above-described heating control of the compressor 1 will be described by using FIG. 9.

Figure 9:
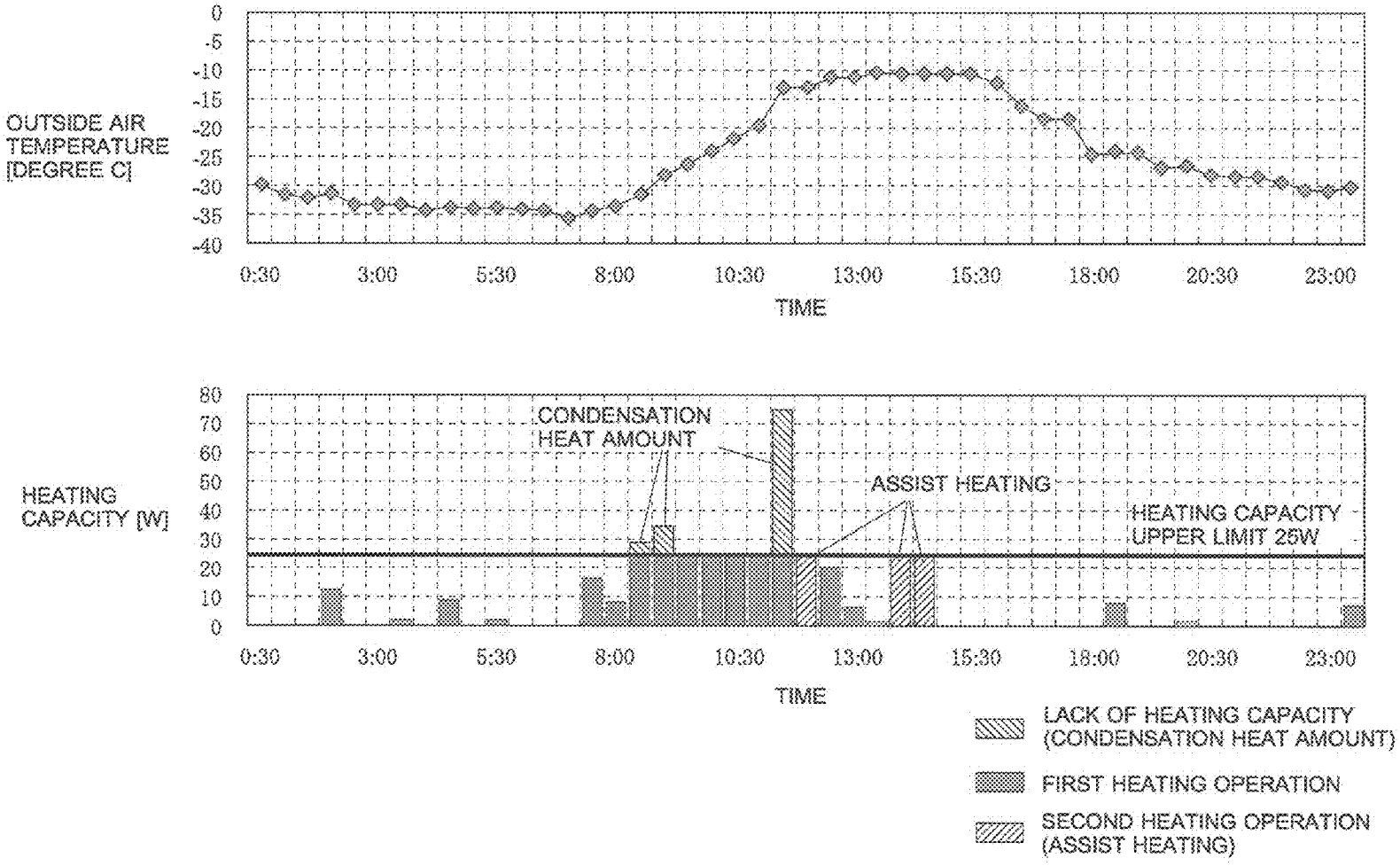
FIG. 9 is a graph illustrating a relationship between a change of an outside air temperature and heating capacity at the time of change in Embodiment 1 of the present invention.

FIG. 9 is a graph illustrating a relationship of the outside air temperature change and the heating capacity at that time in Embodiment 1 of the present invention.

The upper graph in FIG. 9 illustrates a relationship between the outside air temperature and time. The lower graph in FIG. 9 illustrates the heating capacity of the compressor heating portion 10 by the above-described heating operation.

The predetermined time dt is 30 minutes. The heating capacity upper limit Pmax is 25 W.

As illustrated in FIG. 9, while the outside air temperature (refrigerant temperature) is constant or decreasing, the outside air temperature change rate Tah is zero or below, and the heating capacity is zero.

As described above, when the refrigerant is not condensed, heating of the compressor 1 can be stopped.

On the other hand, when the outside air temperature (refrigerant temperature) increases, the heating capacity increases/decreases in proportion to the change rate.

As described above, during rise of the outside air temperature (refrigerant temperature), by heating the compressor 1 with the heating capacity matching the heat exchange amount Qr (condensation capacity) of the compressor 1, condensation of refrigerant in the compressor 1 can be prevented without excessively heating the compressor 1.

Moreover, if the required heating capacity exceeds the heating capacity upper limit, a heat amount corresponding to the heating capacity (condensation heat amount) exceeding the upper limit is provided in the second heating operation (assist heating) while the outside air temperature (refrigerant temperature) is constant or decreasing, whereby the refrigerant condensed in the compressor 1 due to insufficient heating capacity can be evaporated.

Advantages of Embodiment 1

In this embodiment as described above, when the compressor 1 is in the stopped state and the outside air temperature change rate Tah (refrigerant temperature change rate) exceeds zero, the first heating operation is started. During the first heating operation, the heating capacity of the compressor heating portion 10 is set in a range not more than the heating capacity upper limit Pmax on the basis of the outside air temperature change rate Tah (refrigerant temperature change rate).

Thus, without excessively heating the compressor 1, the refrigerant can be prevented from condensing and flooding the compressor 1. Thus, power consumption while the air-conditioning apparatus is stopped, that is, standby power can be suppressed.

Also, by preventing the condensation of refrigerant in the compressor 1, drop in the concentration of the lubricant oil can be suppressed, and burn in the compressor 1 due to poor lubrication or an increase in the start load of the compressor can be prevented.

Also, in this embodiment, on the basis of the current outside temperature change rate Tah (refrigerant temperature change rate) and the set heating capacity of the compressor heating portion 10, the remaining refrigerant liquid amount Ms, which is a refrigerant amount condensed in the compressor 1 that had not been evaporated even in the first heating operation, is acquired. When the compressor 1 is in the stopped state and the outside air temperature change rate Tah (refrigerant temperature change rate) is zero or below and also, the remaining refrigerant liquid amount Ms exceeds zero, the second heating operation is started. In the second heating operation, the compressor heating portion 10 is controlled on the basis of the remaining refrigerant liquid amount Ms, and the refrigerant condensed in the compressor 1 is evaporated.

Thus, the refrigerant condensed in the compressor 1 due to insufficient heating capacity in the first heating operation can be evaporated in the second heating operation (assist heating). Thus, the refrigerant can be prevented from condensing and flooding the compressor 1.

Also, in this embodiment, in the first heating operation, the heating capacity of the compressor heating portion 10 is set in a range not more than the heating capacity upper limit Pmax according to the required heating capacity P* that is proportionate to the current outside air temperature change rate Tah (refrigerant temperature change rate). Then, the estimated condensation liquid amount ΔMs(i) is acquired on the basis of the difference between the required heating capacity P* and the set heating capacity, and this estimated condensation liquid amount ΔMs(i) is integrated so as to acquire the remaining refrigerant liquid amount Ms.

Therefore, the refrigerant condensed in the compressor 1 due to insufficient heating capacity in the first heating operation can be acquired.

Also, in this embodiment, in the second heating operation, the assist heating time Δth required for the remaining refrigerant liquid amount Ms to evaporate is acquired on the basis of the remaining refrigerant liquid amount Ms. Then, the compressor heating portion 10 is set to the predetermined heating capacity, and the compressor 1 is heated until the assist heating time Δth has elapsed.

Thus, the refrigerant condensed in the compressor 1 due to insufficient heating capacity in the first heating operation can be evaporated. Thus, the refrigerant can be prevented from condensing and flooding the compressor 1.

Also, after the assist heating time Δth has elapsed, the heating of the compressor 1 can be stopped. Thus, excessive heating of the compressor 1 can be prevented, and power consumption while the air-conditioning apparatus 50 is stopped can be suppressed.

Also, in this embodiment, if the compressor 1 is started during the second heating operation, the second heating operation is stopped, and the remaining refrigerant liquid amount Ms and the assist heating time Δth are set to zero.

Thus, if the refrigerant stagnating in the compressor 1 with the operation of compressor 1 is evaporated, the remaining refrigerant liquid amount Ms and the assist heating time Δth can be set to zero, and the refrigerant amount stagnating in the compressor 1 can be acquired with accuracy.

Also, in this embodiment, if the outside temperature change rate Tah exceeds zero while the compressor 1 is in the stopped state, the second heating operation is stopped, and at least either of the remaining refrigerant liquid amount or the assist heating time during the stoppage is maintained, and the first heating operation is started.

Thus, even when the heating operation transits between the first heating operation and the second heating operation, the refrigerant amount stagnating in the compressor 1 can be acquired with accuracy.

In Embodiment 1, the refrigerant with the remaining refrigerant liquid amount Ms is evaporated in the second heating operation, but it may be so configured that the heating capacity exceeding the required heating capacity P* is set in the first heating operation and evaporate the refrigerant condensed in the compressor 1.

That is, the controller 31 sets the heating capacity of the compressor heating portion 10 to be in a range exceeding the required heating capacity P* and not more than the heating capacity upper limit Pmax if the required heating capacity P* is less than the heating capacity upper limit Pmax in the first heating operation. For example, it is set to the heating capacity upper limit Pmax.

Then, the refrigerant amount evaporated in the compressor 1 in the predetermined time dt is acquired on the basis of the difference between the set heating capacity (=heating capacity upper limit Pmax) and the required heating capacity P*, and this refrigerant amount is subtracted from the remaining refrigerant liquid amount Ms.

This evaporated refrigerant amount Mm can be acquired by the expression (16) by using an evaporation flow rate Ge' with the heating capacity (Ph−P*) that is the difference between the set heating capacity Ph and the required heating capacity P*.

$$Mm = Ge' \cdot dt \tag{16}$$

As described above, by setting the heating capacity exceeding the required heating capacity P* in the first heating operation, the refrigerant condensed in the compressor 1 can be evaporated also in the first heating operation.

Embodiment 2

Start Condition by Compressor Shell Temperature

As described above, if the compressor shell temperature is lower than the refrigerant temperature (outside air temperature), the refrigerant is likely to flood the compressor 1. On the contrary, if the compressor shell temperature is higher than the refrigerant temperature (outside air temperature), the refrigerant does not condense, and there is no need to heat the compressor.

From the above, in Embodiment 2, an embodiment in which the condition of the compressor shell temperature is added to the starting condition of the first heating operation so that the power consumption is further suppressed will be described.

The configuration in this embodiment is the same as that of Embodiment 1, and the same reference numerals are given to the same portions.

Figure 10:
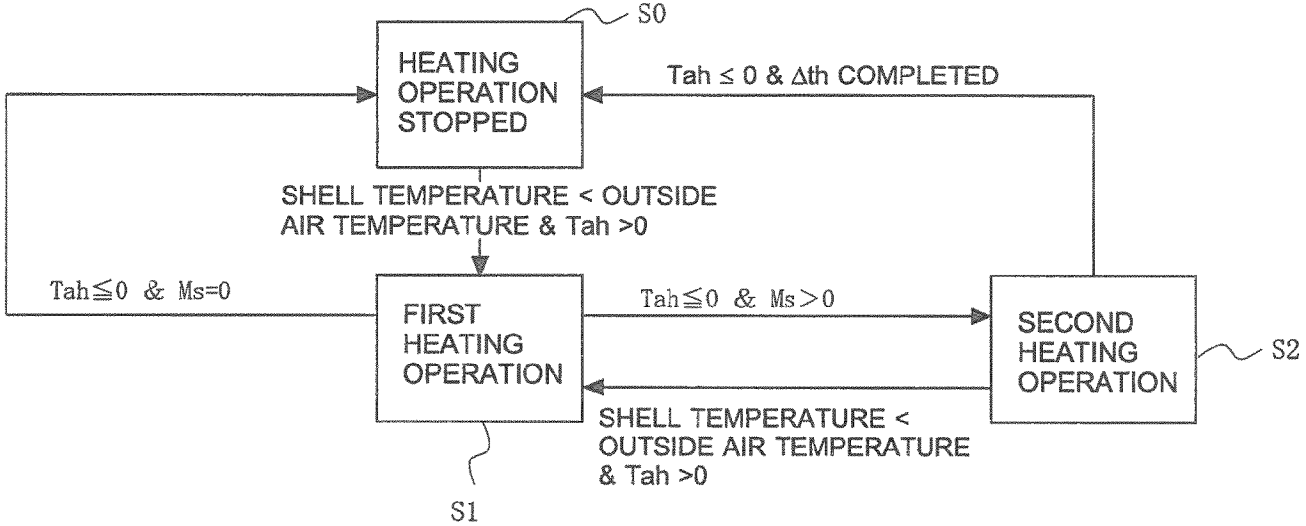
FIG. 10 is a diagram illustrating a transition of the heating operation in Embodiment 2 of the present invention.

FIG. 10 is a diagram illustrating a transition of the heating operation in Embodiment 2 of the present invention.

As illustrated in FIG. 10, the controller 31 in this embodiment starts the first heating operation if all the following conditions are satisfied (logical product).

The other operations of the first heating operation and the second heating operation are the same as those in Embodiment 1.

[First Heating Operation]

<Starting Condition>

(a) The compressor is in the stopped state (b) Tah>0

(c) The compressor shell temperature<outside air temperature Ta

For the compressor shell temperature, a detected value itself of the compressor temperature sensor 21 may be used or considering a detection error of the sensor, a value obtained by subtracting a predetermined value from the detected value may be used.

By means of such operations, when the compressor shell temperature is in a high temperature state such as the time immediately after the stop of the operation of the compressor 1, for example, the compressor 1 is not heated even if the outside air temperature increases (Tah>0).

Advantages of Embodiment 2

In this embodiment as described above, when the compressor 1 is in the stopped state and the outside air temperature (refrigerant temperature) exceeds the compressor shell temperature, and further when the outside air temperature change rate Tah (refrigerant temperature change rate) exceeds zero, the first heating operations starts.

Thus, when it is less likely that the refrigerant will flood the compressor, it can be set such that the heating of the compressor 1 is not performed. Thus, in addition to the advantages of Embodiment 1, power consumption while the air-conditioning apparatus is stopped can be further suppressed.

Embodiment 3

In Embodiments 1 and 2, the heating operation is stopped when the outside air temperature change rate Tah falls to zero or below during the first heating operation and also, when the remaining refrigerant liquid amount Ms is zero.

In such operations, when the outside air temperature change rate Tah temporarily falls to zero or below due to hunting or the like, the state transits to the heating state again after the compressor heating portion 10 is temporarily stopped.

If electricity is supplied to the electric motor portion 62 in an open phase, for example, as the compressor heating portion 10, transition from the stopped state to the heating state requires inverter control calculating the initial condition or a waveform generation process or the like. Thus, some time is needed until the heating operation is started, and desired heating capacity might not be obtained immediately.

Therefore, in Embodiment 3, an embodiment in which heating is continued by a third heating operation for a certain time when the remaining refrigerant liquid amount Ms is zero after the end of the first heating operation will be described.

The configuration in this embodiment is the same as that of Embodiment 1, and the same reference numerals are given to the same portions.

Figure 11:
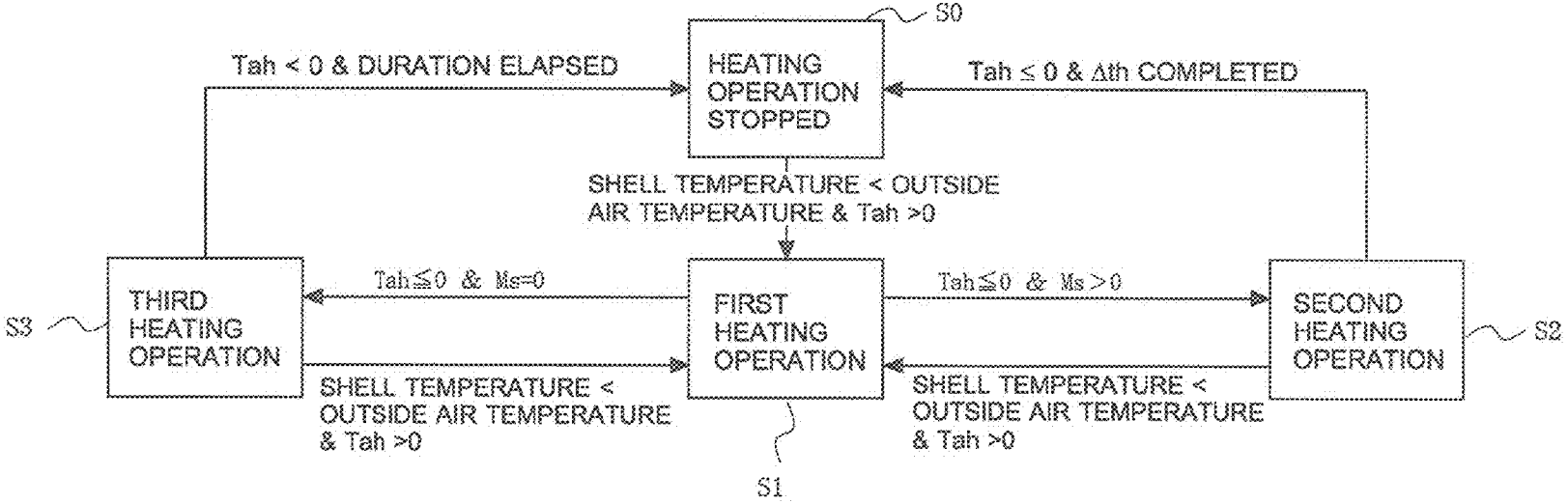
FIG. 11 is a diagram illustrating a transition of the heating operation in Embodiment 3 of the present invention.

FIG. 11 is a diagram illustrating a transition of the heating operation in Embodiment 3 of the present invention.

On the basis of each step in FIG. 11, differences from Embodiments 1 and 2 will be mainly described below.

(S0, S1, S2)

Similarly to Embodiment 1, the outside air temperature change rate Tah is calculated, and if the outside air temperature change rate Tah exceeds zero, the first heating operation is started.

If the outside air temperature change rate Tah falls to zero or below during the first heating operation, the first heating operation is ended, while if the remaining refrigerant liquid amount Ms exceeds zero, the second heating operation is started.

(S3)

When the first heating operation is ended, if the compressor 1 is in the stopped state and the remaining refrigerant liquid amount is zero, the third heating operation is started.

And if the starting condition of the first heating operation is satisfied during the third heating operation, the third heating operation is ended, and the first heating operation is started.

On the other hand, if the outside air temperature change rate is zero or below and also, a duration, which will be described later, has elapsed, the controller 31 stops the heating operation (S0).

Here, details of the third heating operation will be described.

[Third Heating Operation]

<Starting Condition>

If all the following conditions are satisfied (logical product), the third heating operation is started.

(a) The compressor 1 is in the stopped state (b) The first heating operation is ended with Tah≤0 (the ending condition (a) of the first heating operation is satisfied)

(c) Remaining refrigerant liquid amount Ms=0

<Contents of Heating Control>

The controller 31 sets the heating capacity of the compressor heating portion 10 to a predetermined heating capacity and heats the compressor 1 until a predetermined duration has elapsed.

Here, as the duration, 30 minutes, for example, is set.

Also, as the predetermined heating capacity, for example, the minimum value of the heating capacity that can be set for the compressor heating portion 10 (hereinafter referred to as "heating capacity lower limit Pmin") is set. The heating capacity lower limit is Pmin≠0.

The heating capacity is not limited to that but can be set arbitrarily in a range larger than zero and not more than the heating capacity upper limit Pmax.

<Ending Condition>

If any of the following conditions is satisfied (logical sum), the third heating operation is ended.

(a) If the duration has elapsed (b) If the compressor 1 is started (c) If the starting condition of the first heating operation is satisfied By means of the above operations, even if the outside air temperature change rate Tah is zero or below and the remaining refrigerant liquid amount is zero, heating can be continued for the predetermined duration.

Advantages of Embodiment 3

As described above in this embodiment, when the outside air temperature change rate Tah falls to zero or below during the first heating operation, the first heating operation is ended, and when the compressor 1 is in the stopped state and the remaining refrigerant liquid amount is zero after the end of the first heating operation, the third heating operation is started. The compressor heating portion 10 is set to the predetermined heating capacity and the compressor 1 is heated until the predetermined duration has elapsed in the third heating operation.

Thus, after the outside air temperature change rate Tah falls to zero or below, the state does not transit to the stopped state until the predetermined duration has elapsed, and if the starting condition of the first heating operation is satisfied during this duration, desired heating capacity can be immediately obtained.

Embodiment 4

After the air-conditioning apparatus 50 is installed or if the air-conditioning apparatus 50 has been OFF for a long time, it is likely that the refrigerant is stagnated in the compressor 1.

In Embodiment 4, in addition to the operations in Embodiments 1 to 3, an embodiment in which heating is performed for a certain time by a fourth heating operation when the air-conditioning apparatus 50 is turned on will be described.

The configuration in this embodiment is the same as that of Embodiment 1, and the same reference numerals are given to the same portions.

Figure 12:
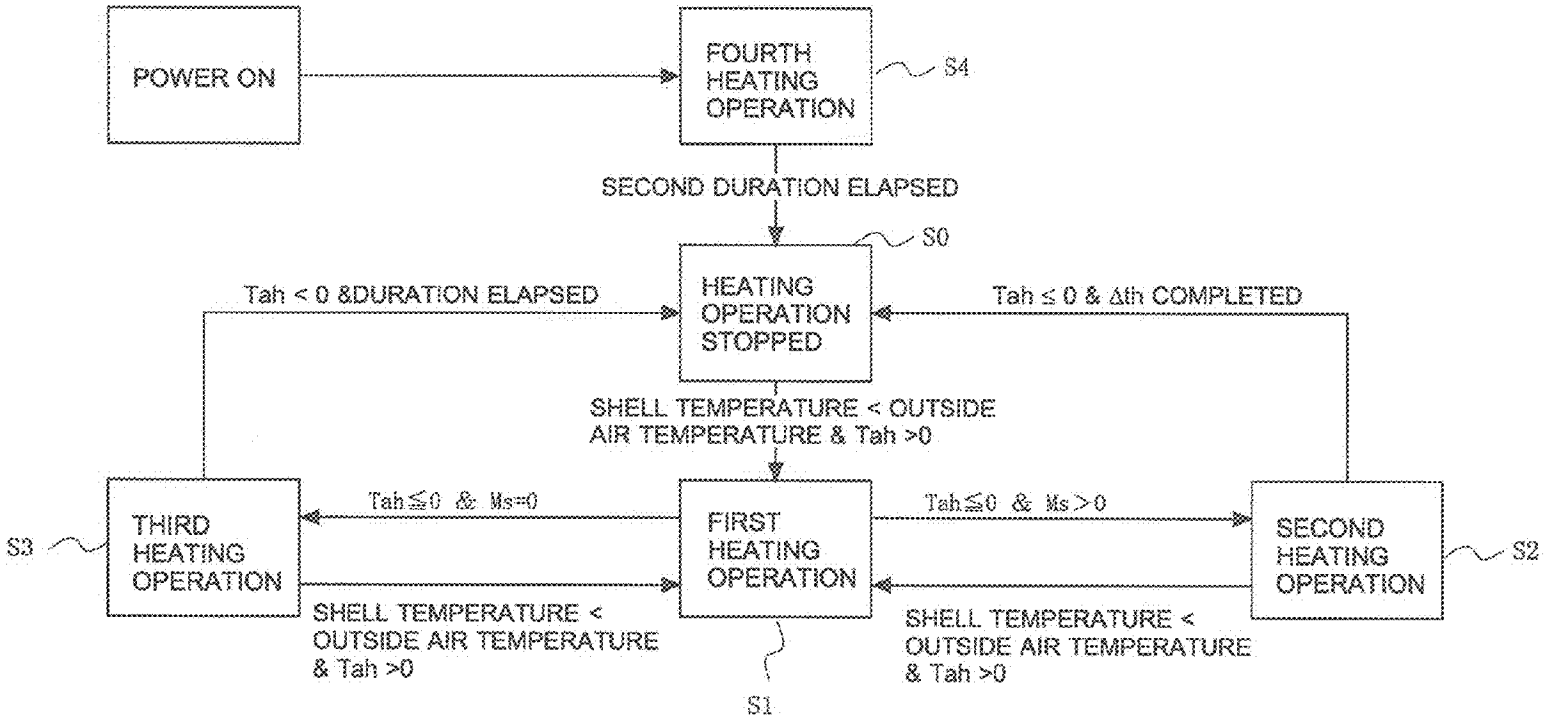
FIG. 12 is a diagram illustrating a transition of the heating operation in Embodiment 4 of the present invention.

FIG. 12 is a diagram illustrating a transition of the heating operation in Embodiment 4 of the present invention.

As illustrated in FIG. 12, the controller 31 in this embodiment starts the fourth heating operation when the power is turned on. The first to third heating operations are the same as those in Embodiments 1 to 3.

Details of the fourth heating operation will be described below.

<Starting Condition>

If all the following conditions are satisfied (logical product), the fourth heating operation is started.

(a) The air-conditioning apparatus 50 is powered on (immediately after the initial processing is completed)

(b) The compressor 1 is in the stopped state

<Contents of Heating Control>

The controller 31 sets the heating capacity of the compressor heating portion 10 to a predetermined heating capacity and heats the compressor 1 until a predetermined second duration has elapsed.

Here, the predetermined heating capacity is set to the heating capacity upper limit Pmax, for example.

The heating capacity is not limited to that but can be set arbitrarily in a range larger than zero and not more than the heating capacity upper limit Pmax.

Also, as the second duration, the maximum amount of the refrigerant stagnating in the compressor 1 (worst case) is assumed, for example, and time required for the refrigerant in the maximum amount to be evaporated with the predetermined heating capacity is set.

<Ending Condition>

If any of the following conditions is satisfied (logical sum), the fourth heating operation is ended.

(a) If the second duration has elapsed (b) If the compressor 1 is started

In the above description, the starting conditions include turning the power on, but the present invention is not limited to that.

For example, it may be so configured that the compressor 1 is in the stopped state and the heating stopped state of the compressor 1 by the compressor heating portion 10 has elapsed for a predetermined stoppage time or more, and that the fourth heating operation is started.

As a result, even if temperature rise is not detected for a long time due to freezing of the outside air temperature sensor 23, for example, the stagnating refrigerant can be evaporated by the fourth heating operation.

Advantages of Embodiment 4

As described above in this embodiment, when the compressor 1 is in the stopped state and at least either the air-conditioning apparatus 50 is powered on or the heating stopped state of the compressor 1 by the compressor heating portion 10 has continued for the predetermined stoppage time or more, the fourth heating operation is started. In the fourth heating operation, the compressor heating portion 10 is set to the predetermined heating capacity, and the compressor 1 is heated until the predetermined second duration has elapsed.

Thus, the refrigerant that has condensed in the compressor 1 before the power had been turned on can be evaporated.

Also, if it is likely that the refrigerant is stagnating since the heating operation has not been performed for a long time, the compressor 1 can be heated.

Thus, condensation and flooding of the refrigerant in the compressor 1 can be prevented.

Embodiment 5

In Embodiment 5, an embodiment in which information on the current operating state is informed with informing means will be described.

Figure 13:
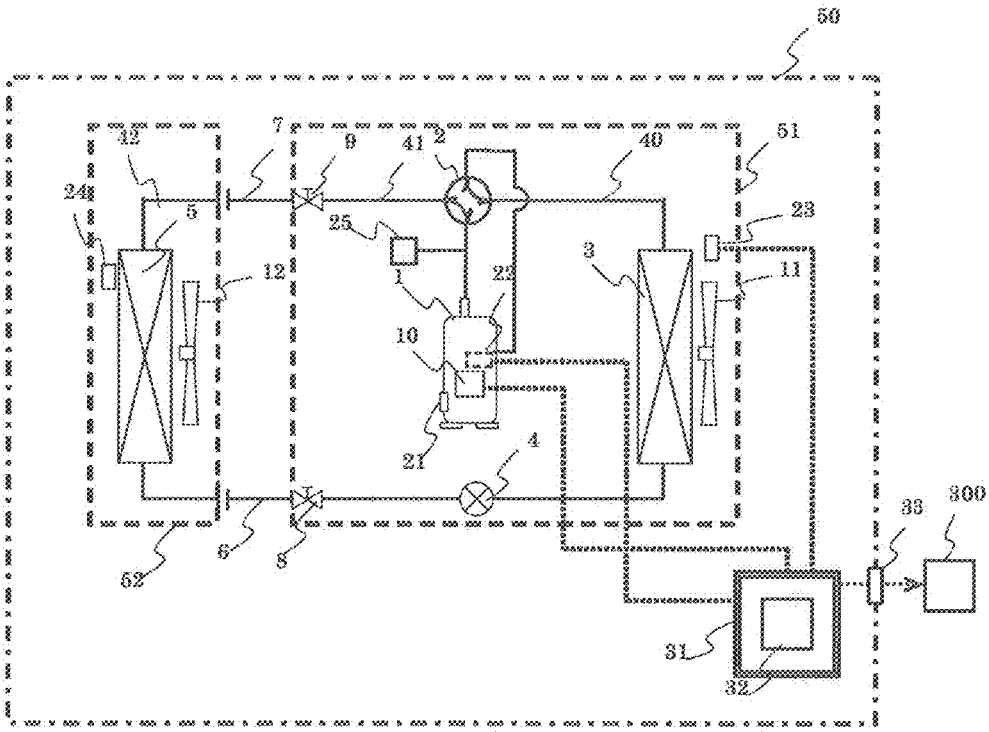
FIG. 13 is a refrigerant cycle diagram of an air-conditioning apparatus in Embodiment 5 of the present invention.

FIG. 13 is a refrigerant cycle diagram of an air-conditioning apparatus in Embodiment 5 of the present invention.

As illustrated in FIG. 13, in the air-conditioning apparatus 50 in this embodiment, an output terminal 33 that outputs information relating to control of the controller 31 is disposed.

To this output terminal 33, an information display device 300 that displays the information from the controller 31 is connected.

The other configurations are the same as those in Embodiment 1, and the same reference numerals are given to the same portions.

The "information display device 300" corresponds to "informing means" in the present invention.

With the above configuration, the controller 31 outputs the information on the current operating state to the information display device 300 in any of the operation states of the above-described first to fourth heating operations. The information display device 300 displays the above information of the current heating operation.

Here, the example in which the information of the controller 31 is output to the external information display device 300 is described, but the present invention is not limited to that.

For example, it may be so configured that a display portion such as a 7-segment LED is disposed in the controller 31 which may identify the first to fourth heating operations from each other. Also, the display may be made on a display portion of an attached remote controller, for example. Also, the informing means is not limited to a display but sound may be used.

Advantages of Embodiment 5

As described above in this embodiment, information on the current operating state, which is the operation state of either one of the first to fourth heating operations, is informed with the informing means.

Thus, a user can recognize the current operating state.

Embodiment 6

Estimation of Refrigerant Temperature

In Embodiment 6, an embodiment will be described in which, after estimating an outside air temperature Ta* after the predetermined time dt, the change rate of the refrigerant temperature is acquired by using the outside air temperature Ta* after the predetermined time dt and the current outside air temperature Ta.

The configuration in this embodiment is the same as that in Embodiment 1, and the same reference numerals are given to the same portions.

Figure 14:
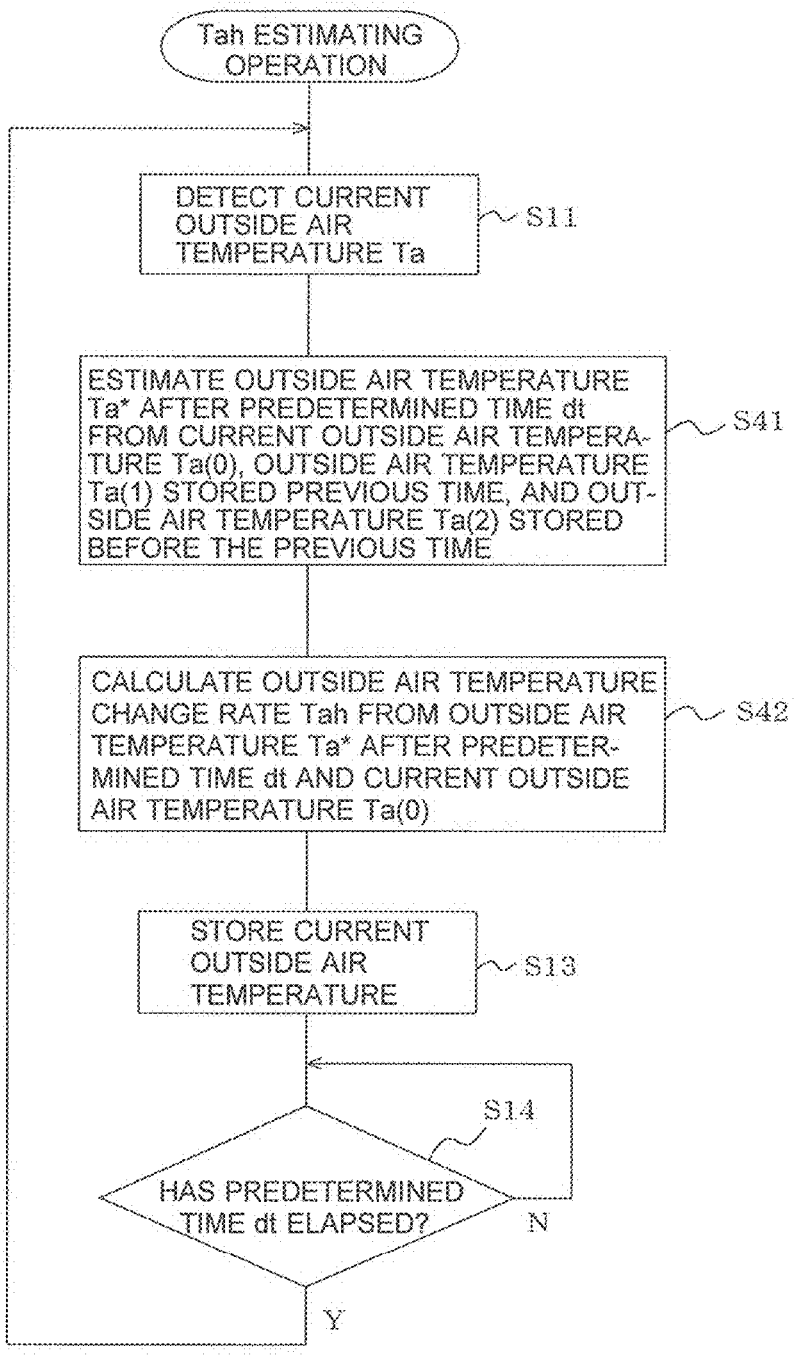
FIG. 14 is a flowchart illustrating a control operation in Embodiment 6 of the present invention.

FIG. 14 is a flowchart illustrating a control operation in Embodiment 6 of the present invention.

On the basis of each step in FIG. 14, differences from Embodiment 1 (FIG. 6) will be mainly described below.

The same reference numerals are given to the same steps as those in Embodiment 1.

(S41)

The calculating device 32 of the controller 31 estimates the outside air temperature Ta* after the predetermined time dt from the current time by using the current outside air temperature Ta(0) detected at Step S11, the outside air temperature Ta(1) the predetermined time dt earlier stored at the previous Step S13, and the outside air temperature Ta(2) stored at Step S13 before the previous time (the predetermined time dt prior to the outside air temperature Ta (1)).

If the outside air temperatures Ta(1) and Ta(2) are not stored such as in the initial operation, Steps S41 and S42 are omitted, and the routine proceeds to Step S13.

For this estimating method, a quadratic approximate function or a first order lag function to calculate an approximate, for example, can be used.

The estimating method is not limited to that, and the outside air temperature Ta* after the predetermined time dt may be estimated by a statistical method such as a least-squares method, for example.

Also, the outside air temperature Ta* after the predetermined time dt may be estimated by acquiring change rates based on the increment of the outside air temperatures Ta(0), Ta(1), and Ta(2).

Also, the outside air temperature Ta* may be estimated by sequentially storing changes of the outside air temperature of a past day and by comparing the change of the outside air temperature of the past day with the detected outside air temperatures Ta(0), Ta(1), and Ta(2).

In this embodiment, the example in which the outside air temperature Ta* after the predetermined time dt is estimated using the current outside air temperature Ta(0), the previous outside air temperature Ta(1), and the outside air temperature Ta(2) before the previous time is described, but the present invention is not limited to that.

The outside air temperature Ta* after the predetermined time dt may be estimated using at least the current outside air temperature Ta(0) and the outside air temperature Ta(1) the predetermined time dt earlier.

Also, outside air temperatures Ta(n) (n=3, 4, . . . ) detected further before the outside air temperature Ta(2) before the previous time may be used.

(S42)

The calculating device 32 of the controller 31 calculates the outside air temperature change rate Tah (=(dTa/dt)=(Ta*−Ta(0))/dt) using the outside air temperature Ta* after the predetermined time dt estimated at Step S42 and the current outside air temperature Ta(0) detected at Step S11.

Then, similarly to Embodiment 1, Steps S13 and S14 are executed.

Advantages of Embodiment 6

As described in this embodiment, the outside air temperature Ta* after the predetermined time dt is estimated using at least the current outside air temperature Ta(0) and the outside air temperature Ta(1) the predetermined time dt earlier and acquires the outside air temperature change rate Tah using the outside air temperature Ta* after the predetermined time dt and the current outside air temperature Ta(0).

Thus, even if the outside air temperature is continuously changing and the refrigerant temperature is also changing with that, the heating amount to be required after the predetermined time has elapsed can be estimated, and probability of the heating amount becoming insufficient after the predetermined time can be reduced.

Therefore, the compressor 1 can be heated with the heating capacity according to the change of the outside air temperature (refrigerant temperature), and condensation of refrigerant in the compressor 1 can be further suppressed.

Embodiment 7

Forced Termination

In Embodiment 7, an embodiment in which heating is stopped when the compressor shell temperature exceeds the upper limit temperature will be described.

The configuration in this embodiment is the same as that in Embodiment 1, and the same reference numerals are given to the same portions.

The controller 31 in this embodiment monitors the compressor shell temperature constantly or regularly. If the compressor shell temperature exceeds the predetermined upper limit temperature, the controller 31 stops (forcibly terminates) heating of the compressor 1 by the compressor heating portion 10 regardless of the above-described starting condition of each heating operation.

If the compressor shell temperature drops below the outside air temperature (refrigerant temperature), the forced termination is canceled, control is executed on the basis of the above-described starting condition of each heating operation or the like.

Here, as the predetermined upper limit temperature, a temperature higher than the temperature assumed to be the outside air temperature, for example (75 degrees C., for example), is set.

For the compressor shell temperature, the detected value of the compressor temperature sensor 21 itself may be used, or considering a detection error of the sensor, a value obtained by subtracting a predetermined value from the detected value may be used as the compressor shell temperature.

Advantages of Embodiment 7

As described above in this embodiment, the compressor shell temperature is obtained, and when the compressor shell temperature exceeds the outside air temperature (refrigerant temperature) and also when the compressor shell temperature exceeds the predetermined upper limit temperature, heating of the compressor 1 by the compressor heating portion 10 is stopped.

Thus, when it is less likely that the refrigerant will flood the compressor 1, it can be set such that the compressor 1 is not heated. Thus, in addition to the advantages of Embodiments 1 to 6, power consumption while the air-conditioning apparatus is stopped can be further suppressed.

Embodiment 8

Continuous Electricity Supply

In Embodiment 8, an embodiment in which the compressor 1 is heated when the outside air temperature (refrigerant temperature) is at a predetermined lower limit temperature or below will be described.

The configuration in this embodiment is the same as that of Embodiment 1 and the same reference numerals are given to the same portions.

For example, if the refrigerant temperature sensor 22 is constituted by a thermistor, for example, a measurement error might occur outside the range of operation temperature limits such as in a low temperature zone.

If such a measurement error occurs, the appropriate required heating capacity cannot be acquired, and an error is caused in a calculated value of the remaining refrigerant liquid amount Ms, and the refrigerant might flood the compressor 1.

Thus, the controller 31 in this embodiment sets the compressor heating portion 10 to a predetermined heating capacity and heats (continuously supplies electricity to) the compressor 1 regardless of the above-described starting condition of each heating operation when the outside air temperature is at the predetermined lower limit temperature or below.

Here, the predetermined lower limit temperature, a temperature at which measurement accuracy drops due to characteristics of the refrigerant temperature sensor 22 or the like, for example, is set.

For the predetermined heating capacity, the heating capacity upper limit Pmax is set, for example.

The present invention is not limited to that, and an arbitrary heating capacity below or the same as the heating capacity upper limit Pmax may be used.

It may be configured such that the continuous supply of electricity is cancelled when the outside air temperature exceeds the temperature obtained by adding a predetermined value to the lower limit temperature.

As a result, when the outside air temperature is near the lower limit temperature, occurrence of hunting can be suppressed.

Advantages of Embodiment 8

As described above, in this embodiment, when the outside air temperature (refrigerant temperature) is at the predetermined lower limit temperature or below, the compressor heating portion 10 is set to the predetermined heating capacity, and the compressor 1 is heated.

Thus, if it is likely that the refrigerant will flood the compressor 1, the compressor 1 can be heated. Thus, the refrigerant can be prevented from condensing and flooding the compressor 1.

What is claimed is:

1. An air-conditioning apparatus comprising:

a refrigerant cycle in which at least a compressor, a heat-source-side heat exchanger, expanding means, and a use-side heat exchanger are connected by a refrigerant pipeline and through which a refrigerant is circulated;

a heating means that heats the compressor; and a control means that obtains a refrigerant temperature in the compressor and controls the heating means on the basis of a change rate of the refrigerant temperature per a predetermined time, wherein the control means is configured to:

start a first heating operation when the compressor is in a stopped state and the change rate of the refrigerant temperature exceeds zero;

in the first heating operation, set a heating capacity of the heating means to be in a range not more than a heating capacity upper limit on the basis of the change rate of the refrigerant temperature and acquires a remaining refrigerant liquid amount, which is a refrigerant amount condensed in the compressor that had not been evaporated in the first heating operation, on the basis of the change rate of the refrigerant temperature and the heating capacity;

start a second heating operation when the compressor is in the stopped state, the change rate of the refrigerant temperature is zero or below, and the remaining refrigerant liquid amount exceeds zero; and in the second heating operation, control the heating means on the basis of the remaining refrigerant liquid amount and allow the refrigerant condensed in the compressor to evaporate.

2. The air-conditioning apparatus of claim 1, wherein the control means is configured to:

obtain a temperature of the compressor; and start the first heating operation when the compressor is in the stopped state, the refrigerant temperature exceeds the temperature of the compressor, and the change rate of the refrigerant temperature exceeds zero.

3. The air-conditioning apparatus of claim 1, wherein the control means is configured to:

end the first heating operation when the change rate of the refrigerant temperature falls to zero or below during the first heating operation;

start a third heating operation when the compressor is in the stopped state and the remaining refrigerant liquid amount is zero after the first heating operation is ended; and in the third heating operation, set the heating means to a predetermined heating capacity and heat the compressor until a predetermined duration has elapsed.

4. The air-conditioning apparatus of claim 1, wherein the control means is configured to:

start a fourth heating operation when the compressor is in the stopped state and either the air-conditioning apparatus is turned on or the heating of the compressor with the heating means has been continuously in a stopped state for a predetermined stoppage time or more; and in the fourth heating operation, set the heating means to a predetermined heating capacity and heat the compressor until a predetermined second duration has elapsed.

5. The air-conditioning apparatus of claim 4, wherein the control means is configured to:

make informing means to provide information on a current operating state of any of the operation states of the first to fourth heating operations.

6. The air-conditioning apparatus of claim 1, wherein the control means is configured to:

set the heating capacity of the heating means to be not more than the heating capacity upper limit according to a required heating capacity that is proportionate to the change rate of the refrigerant temperature in the first heating operation; and acquire a refrigerant amount condensed in the compressor in the predetermined time on the basis of a difference between the required heating capacity that is proportionate to the change rate of the refrigerant temperature and the set heating capacity, integrate the refrigerant amount and acquire the remaining refrigerant liquid amount.

7. The air-conditioning apparatus of claim 1, wherein the control means is configured to:

acquire a required heating capacity that is proportionate to the change rate of the refrigerant temperature and set the heating capacity of the heating means to be in a range exceeding the required heating capacity and not more than an upper limit of the heating capacity when the required heating capacity is less than the upper limit of the heating capacity in the first heating operation;

acquire a refrigerant amount evaporated in the compressor in the predetermined time on the basis of a difference between the set heating capacity and the required heating capacity; and subtract the refrigerant amount from the remaining refrigerant liquid amount.

8. The air-conditioning apparatus of claim 1, wherein the control means is configured to:

in the second heating operation, acquire, on the basis of the remaining refrigerant liquid amount, an assist heating time which is the time required for the remaining refrigerant liquid amount to evaporate when the heating means has a predetermined heating capacity; and heat the compressor until the assist heating time has elapsed while setting the heating means to the predetermined heating capacity.

9. The air-conditioning apparatus of claim 8, wherein the control means is configured to:

stop the second heating operation and set the remaining refrigerant liquid amount and the assist heating time to zero when the compressor is started; and stop the second heating operation, maintain at least either of the remaining refrigerant liquid amount or the assist heating time, at the time of stoppage, and start the first heating operation when the compressor is in the stopped state and the change rate of the refrigerant temperature exceeds zero.

10. The air-conditioning apparatus of claim 1, wherein the control means is configured to:

acquire the change rate of the refrigerant temperature by using a current refrigerant temperature and a refrigerant temperature obtained the predetermined time earlier.

11. The air-conditioning apparatus of claim 1, wherein the control means is configured to:

estimate a refrigerant temperature after the predetermined time has elapsed by using at least a current refrigerant temperature and a refrigerant temperature obtained the predetermined time earlier; and acquire the change rate of the refrigerant temperature by using the refrigerant temperature after the predetermined time and the current refrigerant temperature.

12. The air-conditioning apparatus of claim 1, wherein the control means is configured to:

obtain a temperature of the compressor; and stop heating of the compressor with the heating means when the temperature of the compressor exceeds the refrigerant temperature and the temperature of the compressor exceeds a predetermined upper limit temperature.

13. The air-conditioning apparatus of claim 1, wherein the control means is configured to heat the compressor while setting the heating means to a predetermined heating capacity when the refrigerant temperature is not more than a predetermined lower limit temperature.

14. The air-conditioning apparatus of claim 1, wherein the heat-source-side heat exchanger has a heat capacity configured to be larger than a heat capacity of the use-side heat exchanger; and the control means is configured to use a temperature of the air, which is used by the heat-source-side heat exchanger to exchange heat with the refrigerant, instead of the refrigerant temperature.

15. The air-conditioning apparatus of claim 1, wherein the use-side heat exchanger has a heat capacity configured to be larger than a heat capacity of the heat-source-side heat exchanger; and the control means is configured to use a temperature of the air, which is used by the use-side heat exchanger to exchange heat with the refrigerant, instead of the refrigerant temperature.

* * * * *